US010672360B2

(12) United States Patent
Furihata et al.

(10) Patent No.: US 10,672,360 B2
(45) Date of Patent: Jun. 2, 2020

(54) DISPLAY DATA CORRECTION BY NUMERICAL OPERATION SUITABLE FOR DISPLAY PANEL DRIVER

(75) Inventors: Hirobumi Furihata, Kanagawa (JP); Takashi Nose, Kanagawa (JP)

(73) Assignee: RENESAS ELECTRONICS CORPORATION, Tokyo (JP)

( * ) Notice: Subject to any disclaimer, the term of this patent is extended or adjusted under 35 U.S.C. 154(b) by 0 days.

(21) Appl. No.: 12/926,961

(22) Filed: Dec. 20, 2010

(65) Prior Publication Data

US 2011/0148942 A1 Jun. 23, 2011

(30) Foreign Application Priority Data

Dec. 22, 2009 (JP) ..... 2009-291443

(51) Int. Cl.
*G09G 5/00* (2006.01)

(52) U.S. Cl.
CPC ..... *G09G 5/003* (2013.01); *G09G 2320/0673* (2013.01)

(58) Field of Classification Search
CPC ... G09G 2320/0673; G09G 5/003; G09G 5/00
USPC ..... 345/89, 690
See application file for complete search history.

(56) References Cited

U.S. PATENT DOCUMENTS 5,408,598 A * 4/1995 Pryor, Jr. ..... 345/442
5,900,884 A * 5/1999 Minami et al. ..... 345/442
6,501,470 B1 * 12/2002 Miura ..... 345/421
8,009,180 B2 * 8/2011 Nose et al. ..... 345/690
8,014,689 B2 * 9/2011 Nishizawa ..... 399/49
2007/0013979 A1 * 1/2007 Nose et al. ..... 358/519
2008/0285990 A1 * 11/2008 Nishizawa ..... 399/49

FOREIGN PATENT DOCUMENTS

JP 5-250479 A 9/1993
JP 05250479 A * 9/1993 ..... G06F 15/72
JP 2007-72085 A 3/2007

OTHER PUBLICATIONS

Dictionary.com, "adjacent," in Dictionary.com Unabridged. Source location: Random House, Inc. http://dictionary.reference.com/browse/adjacent, Nov. 18, 2011, p. 1.*

* cited by examiner

*Primary Examiner* — Jeff Piziali
(74) *Attorney, Agent, or Firm* — McGinn IP Law Group, PLLC

(57) ABSTRACT

A display data correction apparatus is provided with: a control circuit responsive to an input gray-level value for initially providing first to N-th control points (N≥3) defined in a coordinate system in which a first coordinate axis is associated with the input gray-level value and a second coordinate axis is associated with an output gray-level value to be calculated for the input gray-level value; and a processing circuit obtaining an output gray-level value by repeating an update operation in which the first to N-th control points are updated. The degree (N−1) Bezier curve is used as an approximated curve of the gamma curve. The output gray-level value is finally obtained as the coordinate value of a specific point in the degree (N−1) Bezier curve along the second coordinate axis, where the specific point has the coordinate value closest to the input gray-level value along the first coordinate axis.

17 Claims, 18 Drawing Sheets

DISPLAY DATA CORRECTION BY NUMERICAL OPERATION SUITABLE FOR DISPLAY PANEL DRIVER

INCORPORATION BY REFERENCE

This application claims the benefit of priority based on Japanese Patent Application No. 2009-291443, filed on Dec. 22, 2009, the disclosure of which is incorporated herein by reference.

BACKGROUND OF THE INVENTION

1. Field of the Invention

The present invention relates to a display data correction device, a display panel driver and display device using the same. More particularly, the present invention relates to a technique for correcting a grays-level value designated by display data by means of numerical operation for gamma correction or other purposes.

2. Description of the Related Art

Generally, a display panel driver driving a display panel, such as a liquid crystal display panel and a plasma display panel, is configured to provide gamma correction in accordance with the characteristics of the display panel. The gamma correction is a processing for displaying an image with desired brightnesses actually corresponding to gray-level values designated by display data. The display panel usually exhibits a non-linear association of brightness with the signal level of the drive signal (the drive voltage or drive current). For example, a voltage-to-transmission curve (V-T curve) of the liquid crystal panel is normally non-linear. This results in that an image cannot be displayed with desired brightnesses on the display panel when drive signals of signal levels proportional to the gray-level values designated by the display data are supplied to the display panel. The gamma correction is implemented so as to display an image on such a display panel with desired brightnesses correctly corresponding to the designated gray-level values.

The relationship between input data (that is, an input gray-level value) and output data for the gamma correction can be expressed by a gamma curve. The gamma curve is a curve specified in a coordinate system having a horizontal axis corresponding to the input gray-level value and a vertical axis corresponding to the output gray-level value (the gamma-corrected gray-level value). One issue of actual implementation of the gamma correction is architecture for achieving the gamma correction in accordance with a desired gamma curve.

Generally speaking, there are two known architectures for implementing the gamma correction. one known approach is to configure a driver circuit (typically, composed of D/A converters) which provides digital analog conversion for digital display data to thereby generate drive signals, so that the gray-level values nonlinearly correspond to the signal levels of the drive signals. In a controller driver driving a liquid crystal panel, for example, a gray-level voltage generation circuit that supplies gray-level voltages to the D/A converters is configured so that the voltage levels of the gray-level voltages increase nonlinearly to the gray-level values. The gamma correction is achieved by performing digital-to-analog conversion using the gray-level voltages generated nonlinearly to the gray-level values.

Another known approach is to incorporate an arithmetic circuit performing a numeric operation on display data. An advantage of the gamma correction by means of the numeric operation is the high flexibility in setting the gamma characteristics. Different display panels have different gamma characteristics, and installation environment causes an influence on the gamma characteristics. Therefore, high flexibility is desired in setting the gamma characteristics. The approach based on the numeric operation allows providing improved flexibility for setting the gamma characteristics, since the setting can be arbitrarily adjusted by changing parameters used in the numeric operation.

One of the most common techniques for achieving gamma correction based on arithmetic operation on display data is to use an LUT (lookup table) which describes an association of each allowed gray-level value of the input display data with the corresponding gray-level value of corrected display data. When an input display data is supplied, the LUT outputs the gray-level value of the corrected display data corresponding to the gray-level value of the input display data to achieve the gamma correction.

According to the inventors' study, gamma correction processing based on an LUT has two problems as follows. One problem is that the use of an LUT undesirably increases hardware unitization. When the input display data are 10-bit data and the corrected display data are 12-bit data, for example, it is necessary to describe data of $12\times2^{10}\times3$ bits in the LUT; it should be noted that different gamma characteristics need to be set for different display colors. Another problem is that the gamma characteristics cannot be changed over instantly. When an LUT is used for gamma correction, it is required to rewrite the LUT to change over the gamma characteristics. Since it takes long time to rewrite the LUT, it is difficult to instantly change over the gamma characteristics by rewriting the LUT. In another approach, a plurality of LUTs may be prepared for eliminating the necessity of rewriting the LUT. However, this approach undesirably makes the problem of the increase in the hardware utilization more serious.

In this background, the inventers have been studying a technique for achieving gamma correction without using an LUT. Japanese Patent No. 4,086,868 B discloses a technique for achieving gamma correction based on quadric correction arithmetic expressions, which is also developed by the inventors. In this technique, parameters of the correction arithmetic expression are designated by correction point data. That is, the gamma characteristics are designated by the correction point data. The correction point data are defined as values that serve as indices of the gray-level values of corrected display data corresponding to the respective gray-level values of input display data. That is, modification of a value of a correction point data results in modification of the shape of the gamma curve in the vertical direction in a coordinate system in which the horizontal axis corresponds to the gray-level value of the input display data and the vertical axis corresponds to that of the output display data (or the gamma-corrected data). The technique of Japanese Patent No. 4,086,868 B is also designed to improve accuracy in gamma correction by changing over correction arithmetic expressions in response to the correction point data and the input display data.

The study of the inventors, however, there is room for improvement of accuracy in gamma correction and decrease in hardware utilization in the technique of Japanese Patent No. 4,086,868 B. According to the technique of Japanese Patent No. 4,086,868 B, the shape of the gamma curve specified in the coordinate system having the horizontal axis (horizontal direction) indicating the input gray-level value and the vertical axis (vertical direction) indicating the output gray-level value (gamma-corrected gray-level value) can be modified in the vertical direction by changing the correction point data but not modified in the horizontal direction. That is, the technique of Japanese Patent No. 4,086,868 B does not provide flexibility for control of the shape of the gamma curve. This may results in that the technique of Japanese Patent No. 4,086,868 B suffers from a limit in improvement of the accuracy of the gamma correction. Furthermore, the architecture disclosed in Japanese Patent No. 4,086,868 B in which the correction arithmetic expressions are changed over may disadvantageously cause an increase in hardware utilization.

SUMMARY

In an aspect of the present invention, a display data correction apparatus is provided with: a select circuit responsive to an input gray-level value for initially selecting first to N-th control points (N≥3) defined in a coordinate system in which a first coordinate axis is associated with the input gray-level value and a second coordinate axis is associated with an output gray-level value to be calculated for the input gray-level value; and a processing circuit obtaining an output gray-level value by repeating an update operation in which the first to N-th control points are updated. In the update operation, first and second operations are selectively performed in response to a result of comparison of a coordinate value of an (N−1)-th order midpoint along the first coordinate axis with the input gray-level value. The first operation involves determining the coordinate values of the first to N-th control points after the update operation in response to coordinate values of a minimum control point, first to (N−2)-th order minimum midpoints and the (N−1)-th order midpoint before the update operation, and the second operation involves determining the coordinate values of the first to N-th control points after the update operation in response to coordinate values of a maximum control point before the update operation, first to (N−2)-th order maximum midpoints and the (N−1)-th order midpoint before the update operation, where first order midpoints (the number of which is N−1) are each defined as a midpoint of adjacent two of the first to N-th control points; (k+1)-th order midpoints (the number of which is k−1) are each defined as a midpoint of adjacent two of the k-th order midpoints for k satisfying 1≤k≤N−2; the minimum control point is defined as a control point which has the smallest coordinate value along the first coordinate axis among the first to N-th control points; the maximum control point is defined as a control point which has the largest coordinate value along the first coordinate axis among the first to N-th control points; the k-th order minimum midpoint is defined as one which has the smallest coordinate value along the first coordinate axis among the k-th order midpoints, and the k-th order maximum midpoint is defined as one which has the largest coordinate value along the first coordinate axis among the k-th midpoints.

It should be noted that the (N−1)-th order midpoints are in the degree (N−1) Bezier curve. The display data correction apparatus uses a degree (N−1) Bezier curve as an approximated curve of the gamma curve and the repetition of the update operation results in that the coordinate value of the (N−1)-th order midpoint along the first coordinate axis approaches the input gray-level value.

The display data correction apparatus thus constructed can calculate the coordinate value of a specific point in the degree N−1 Bezier curve (which is used as an approximated curve of the gamma curve) along the second coordinate axis, the specific point having the coordinate value closest to the input gray-level value along the first coordinate axis even in a case where the coordinate values of the control points are variable along any of the first and second coordinate axes. It should be noted that the output gray-level value is determined as or on the basis of the coordinate value of the specific point along the second coordinate axis. Accordingly, the display data correction apparatus provides superior flexibility in setting the shape of the gamma curve and thereby effectively improves the accuracy of the gamma curve.

In one embodiment, the first to N-th control points after the update operation are determined as being identical to the minimum control point, first to (N−2)-th order minimum midpoints and the (N−1)-th order midpoint before the update operation, respectively, or to the maximum control point, first to (N−2)-th order maximum midpoints and the (N−1)-th order midpoint before the update operation, respectively. A substantially equivalent operation may be implemented in a case where the first to N-th control points are subjected to parallel displacement before the update operation. In this case, the first to N-th control points after the update operation are determined as being identical to the minimum control point, first to (N−2)-th order minimum midpoints and the (N−1)-th order midpoint after the parallel displacement, respectively, or to the maximum control point, first to (N−2)-th order maximum midpoints and the (N−1)-th order midpoint after the parallel displacement, respectively.

It should be noted that, in the actual implementation of the comparison of the coordinate value of the (N−1)-th order midpoint along the first coordinate axis with the input gray-level value, the coordinate value of the (N−1)-th order midpoint along the first coordinate axis may be directly compared with the input gray-level value; Instead, the comparison may be implemented after subjecting the coordinate value of the (N−1)-th order midpoint along the first coordinate axis and the input gray-level value to a certain arithmetic operation.

In another aspect of the present invention, a display panel driver for driving data lines of a display panel is provided with: a control circuit responsive to an input gray-level value for initially selecting first to N-th control points (N≥3) defined in a coordinate system in which a first coordinate axis is associated with the input gray-level value and a second coordinate axis is associated with an output gray-level value to be calculated for the input gray-level value; a V-T arithmetic processing circuit obtaining an output gray-level value by repeating an update operation in which the first to N-th control points are updated; and a drive circuitry driving a data line in response to the output gray-level value received from the V-T arithmetic processing circuit. In the update operation, first and second operations are selectively performed in response to a result of comparison of a coordinate value of an (N−1)-th order midpoint along the first coordinate axis with the input gray-level value. The first operation involves determining the coordinate values of the first to N-th control points after the update operation in response to coordinate values of a minimum control point, first to (N−2)-th order minimum midpoints and the (N−1)-th order midpoint before the update operation, and the second operation involves determining the coordinate values of the first to N-th control points after the update operation in response to coordinate values of a maximum control point before the update operation, first to (N−2)-th order maximum midpoints and the (N−1)-th order midpoint before the update operation, where first order midpoints (the number of which is N−1) are each defined as a midpoint of adjacent two of the first to N-th control points; (k+1)-th order midpoints (the number of which is k−1) are each defined as a midpoint of adjacent two of the k-th order midpoints for k satisfying $1 \leq k \leq N-2$; the minimum control point is defined as a control point which has the smallest coordinate value along the first coordinate axis among the first to N-th control points; the maximum control point is defined as a control point which has the largest coordinate value along the first coordinate axis among the first to N-th control points; the k-th order minimum midpoint is defined as one which has the smallest coordinate value along the first coordinate axis among the k-th order midpoints, and the k-th order maximum midpoint is defined as one which has the largest coordinate value along the first coordinate axis among the k-th midpoints.

In still another aspect of the present invention, a display device is provided with: a display panel including a data line; a control circuit responsive to an input gray-level value for initially selecting first to N-th control points ($N \geq 3$) defined in a coordinate system in which a first coordinate axis is associated with the input gray-level value and a second coordinate axis is associated with an output gray-level value to be calculated for the input gray-level value; a processing circuit obtaining an output gray-level value by repeating an update operation in which the first to N-th control points are updated; and a drive circuitry driving the data line in response to the output gray-level value. In the update operation, first and second operations are selectively performed in response to a result of comparison of a coordinate value of an (N−1)-th order midpoint along the first coordinate axis with the input gray-level value. The first operation involves determining the coordinate values of the first to N-th control points after the update operation in response to coordinate values of a minimum control point, first to (N−2)-th order minimum midpoints and the (N−1)-th order midpoint before the update operation, and the second operation involves determining the coordinate values of the first to N-th control points after the update operation in response to coordinate values of a maximum control point before the update operation, first to (N−2)-th order maximum midpoints and the (N−1)-th order midpoint before the update operation, where first order midpoints (the number of which is N−1) are each defined as a midpoint of adjacent two of the first to N-th control points; (k+1)-th order midpoints (the number of which is k−1) are each defined as a midpoint of adjacent two of the k-th order midpoints for k satisfying $1 \leq k \leq N-2$; the minimum control point is defined as a control point which has the smallest coordinate value along the first coordinate axis among the first to N-th control points; the maximum control point is defined as a control point which has the largest coordinate value along the first coordinate axis among the first to N-th control points; the k-th order minimum midpoint is defined as one which has the smallest coordinate value along the first coordinate axis among the k-th order midpoints, and the k-th order maximum midpoint is defined as one which has the largest coordinate value along the first coordinate axis among the k-th midpoints.

The present invention allows improving accuracy of correction of the display data, while decreasing hardware utilization necessary for the correction.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Figure 1:
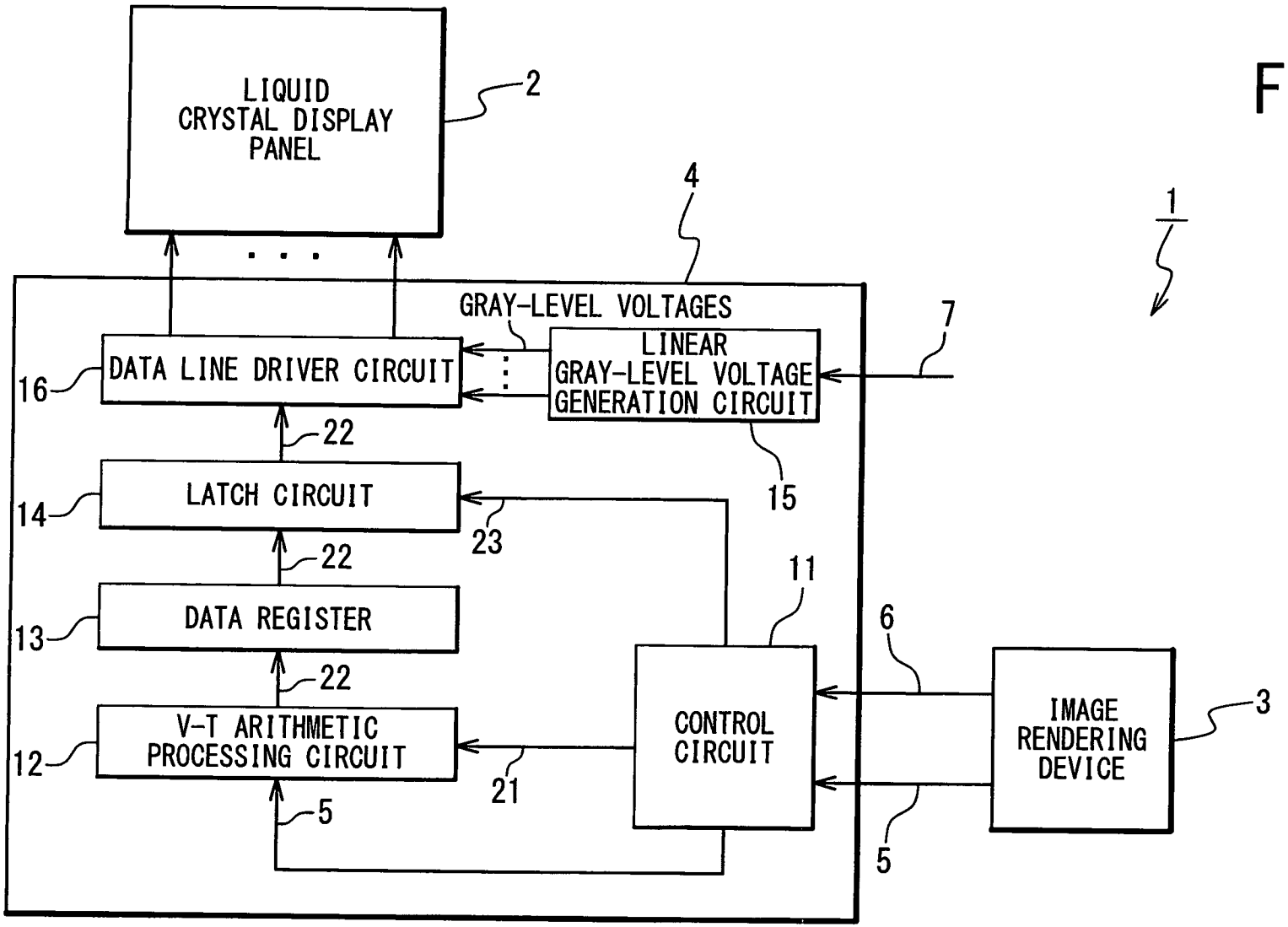
FIG. 1 is a block diagram showing an exemplary configuration of a display device in one embodiment of the present invention.

FIG. 1 is a block diagram showing an exemplary configuration of a display device according to one embodiment of the present invention. The display device shown in FIG. 1 is configured as a liquid crystal display device 1 and configured to include a liquid crystal display panel 2, an image rendering device 3, and a controller driver 4. The liquid crystal display panel 2 includes gate lines, data lines, and liquid crystal pixels (not shown in FIG. 1) provided at respective intersections of the gate lines and the data lines, respectively. The image rendering device 3 supplies input display data 5 designating a gray-level value of each pixel of the liquid crystal display panel 2 and timing control signals 6 (such as a clock signal, a horizontal synchronizing signal, and a vertical synchronizing signal) to the controller driver 4. The image rendering device 3 may include a hardware-based arithmetic processor (such as a DSP (digital signal processor)) or a software-based arithmetic processor (such as a CPU). The controller driver 4 is a display panel driver driving the data lines of the liquid crystal display panel 2 in response to the input display data 5 and the timing control signals 6.

The controller driver 4 includes a control circuit 11, a V-T arithmetic processing circuit 12, a data register 13, a latch circuit 14, a linear gray-level voltage generation circuit 15, and a data line driver circuit 16.

The control circuit 11 transfers the input display data 5 received from the image rendering device 3 to the V-T arithmetic processing circuit 12. Besides, the control circuit 11 controls the respective circuits of the controller driver 4 in response to the timing control signals 6. For example, the control circuit 11 supplies a driving timing control signal 23 to the latch circuit 14 to control the operation timing of the latch circuit 14. Further, the control circuit 11 supplies control point data 21 to the V-T arithmetic processing circuit 12. It should be noted that the control point data 21 are data designating coordinate values of three control points and used in correction operation performed by the V-T arithmetic processing circuit 12 to be described later. The control circuit 11 determines the coordinate values of the three control points in response to each gray-level value of the input display data 5 and supplies control point data 21 to indicate the determined coordinate values of the control points.

The V-T arithmetic processing circuit 12 sequentially performs gamma correction operation on the input display data 5 supplied thereto and sequentially outputs corrected display data 22. The gamma characteristics to be used in the gamma correction operation performed by the V-T arithmetic processing circuit 12 are designated by the control point data 21 supplied from the control circuit 11. One feature of the display device of this embodiment is the gamma correction operation performed by the V-T arithmetic processing circuit 12. The gamma correction operation performed by the V-T arithmetic processing circuit 12 will be described later in detail.

The data register 13 receives and temporarily holds the corrected display data 22 sequentially transmitted from the V-T arithmetic processing circuit 12. The data register 13 has a capacity for one line of pixels (that is, pixels connected to one gate line), and holds the corrected display data 22 for the one line of pixels.

The latch circuit 14 simultaneously latches the corrected display data 22 for the one line of pixels prepared in the data register 13 and transfers the latched corrected display data 22 to the data line driver circuit 16. The latch circuit 14 latches the corrected display data 22 synchronously with the driving timing control signal 23. The latch circuit 14 latches the corrected display data 22 in response to the assertion of the driving timing control signal 23.

The linear gray-level voltage generation circuit 15 generates a set of gray-level voltages corresponding to the respective allowed gray-level values of the corrected display data 22 in response to a gray-level voltage setting signal 7 which is externally supplied. In this embodiment, the linear gray-level voltage generation circuit 15 generates the set of gray-level voltages so that intervals of voltage levels between adjacent gray-level voltages are identical. That is, in this embodiment, the association of the gray-level values of the corrected display data 22 with the corresponding gray-level voltages is linear.

The data line driver circuit 16 drives the respective data lines with the gray-level voltages corresponding to the gray-level values of the corrected display data 22. More specifically, the data line driver circuit 16 selects the gray-level voltages corresponding to the gray-level values of the corrected display data 22 from among the gray-level voltages supplied from the linear gray-level voltage generation circuit 15, and drives the respective data lines with the selected gray-level voltages.

Figure 2:
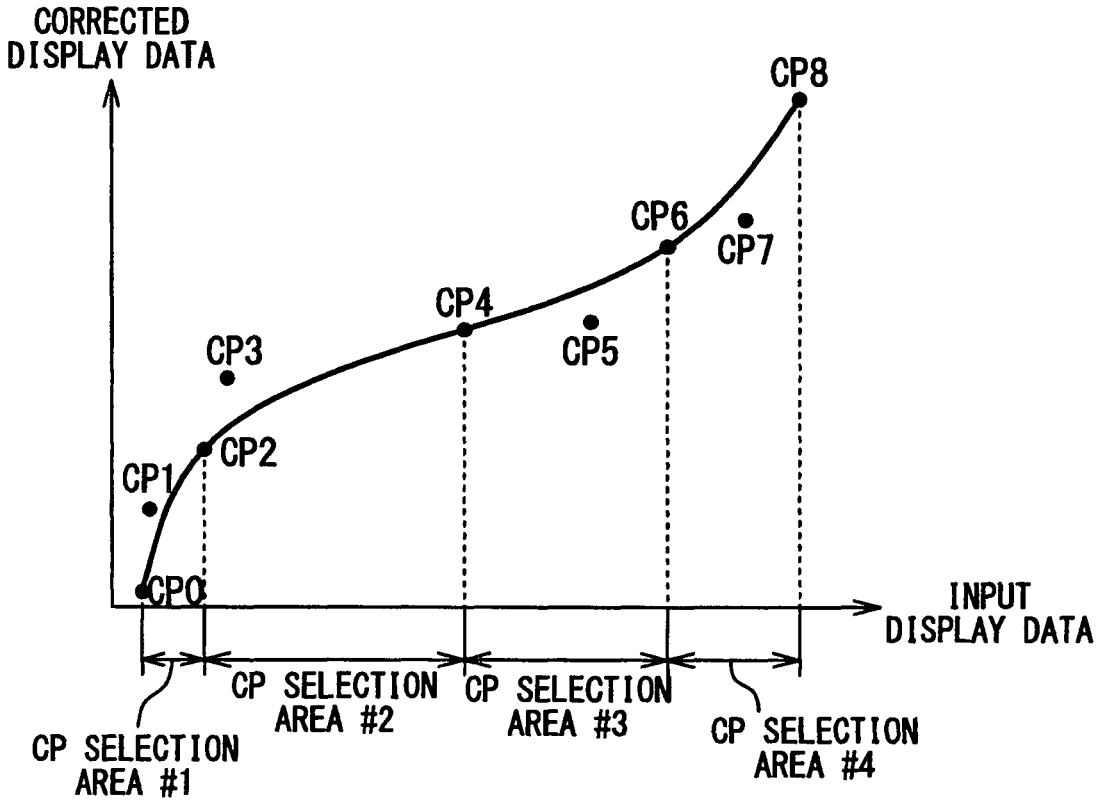
FIG. 2 is a graph showing an association of corrected display data with input display data in one embodiment of the present invention.

A description is next given of the gamma correction operation performed by the V-T arithmetic processing circuit 12 in this embodiment. FIG. 2 is a graph showing the association of the input display data 5 with the corrected display data 22 generated by the V-T arithmetic processing circuit 12. The curve shown in FIG. 2 represents the gamma curve, which is a curve representing the gamma characteristics. In this embodiment, the shape of the gamma curve is designated by coordinate values of the control points in a coordinate system in which the X-axis is associated with the gray-level value of the input display data 5 and the Y-axis is associated with the gray-level value of the corrected display data 22. In FIG. 2, the control points are denoted by reference symbols CP0 to CP8, respectively.

In this embodiment, a plurality of CP selection areas are specified so that each CP selection area contains three control points. In each CP selection area, the gamma curve is represented as a quadric Bezier curve specified by the three control points contained in each CP selection area. Each CP selection area is specified by using X-coordinate values of the control points. In this case, the CP selection area #j is specified as $CPX(2j-2) \leq X \leq CPX(2j)$ where coordinates of each control point CPi are (CPXi, CPYi). Each CP selection area #j contains three control points $CP(2j-2)$, $CP(2j-1)$, and $CP(2j)$. It should be noted that the control points $CP(2j-2)$ and $CP(2j)$ are located on the respective boundaries of the CP selection area #j. When the CP selection area #j is selected, the coordinate values of the control points $CP(2j-2)$, $CP(2j-1)$, and $CP(2j)$ are used for the gamma correction operation in the V-T arithmetic processing circuit 12.

The V-T arithmetic processing circuit 12 implements the gamma correction operation on the input display data 5 in accordance with the gamma curve specified by the control points to generate the corrected display data 22. Although FIG. 2 shows that the number of control points is nine, the number of control points may be arbitrarily changed. Specifying many control points allows controlling the shape of the gamma curve, more accurately.

Figure 3:
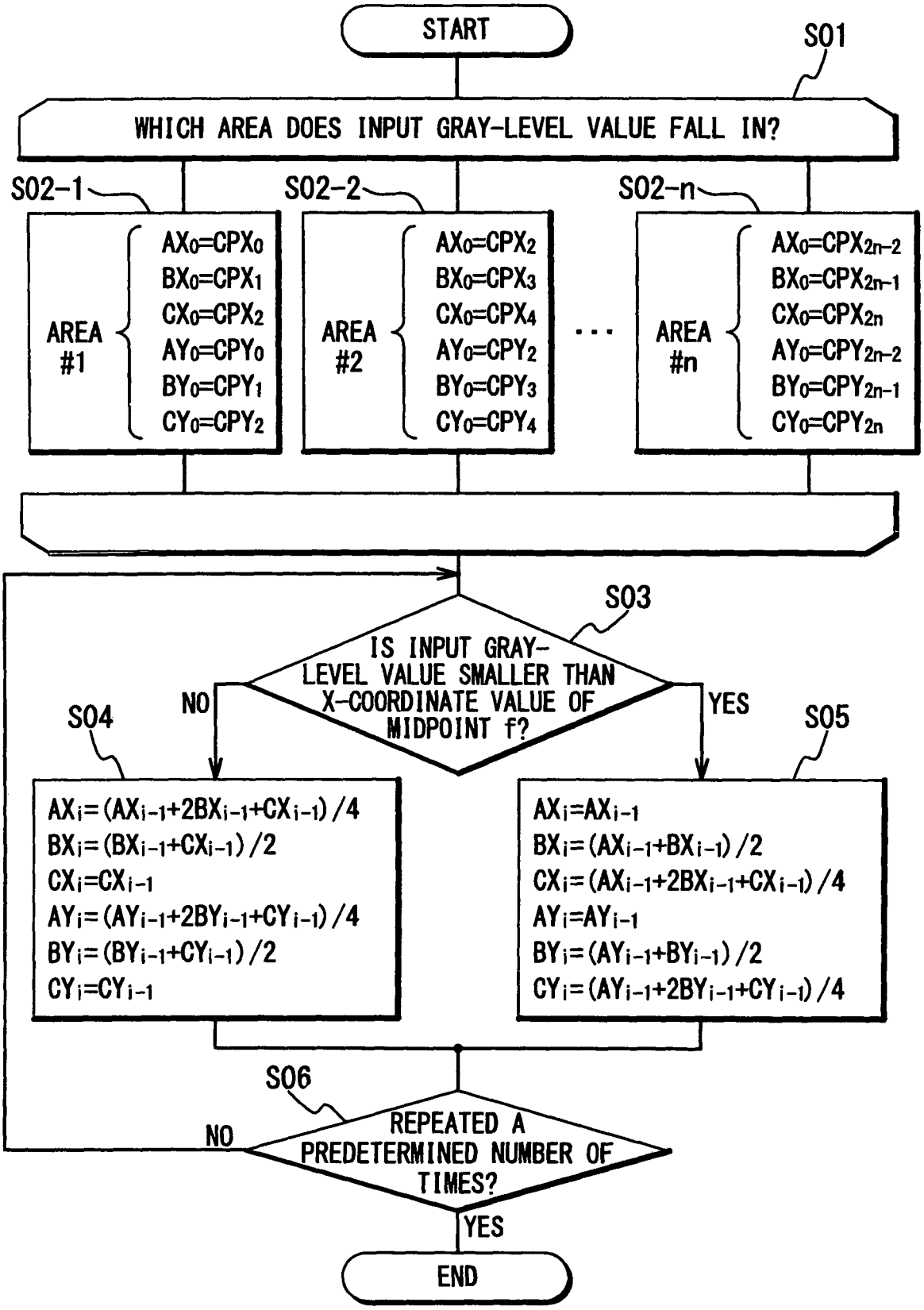
FIG. 3 is a flowchart showing a gamma correction operation algorithm in one embodiment of the present invention.

FIG. 3 is a flowchart showing an exemplary procedure of the gamma correction operation implemented in this embodiment. First, the control circuit 11 selects one of CP selection areas #1 to #4 in response to the gray-level value of the input display data 5 associated with a pixel of interest (hereinafter, simply referred to as "input gray-level value") (Step S01). More specifically, the control circuit 11 selects the CP selection area #j when $CPX(2j-2) \leq X_IN \leq CPX(2j)$ where X_IN is the input gray-level value.

Next, the control circuit 11 forwards the coordinate values of the three control points contained in the selected CP selection area to the V-T arithmetic processing circuit 12 in the form of the control point data 21, and the coordinate values of the control points are set to the V-T arithmetic processing circuit 12 (Steps S02-1 to S02-*n*). In this embodiment, the coordinate values of the control points CP(2*j*−2), CP(2*j*−1), and CP(2*j*) are transmitted to the V-T arithmetic processing circuit 12 when the CP selection area #j is selected.

Although three control points are selected on the basis of the CP selection areas in this embodiment, the method of selecting three control points may be variously modified. In an alternative embodiment, three control points may be selected which have X-coordinate values closest to the input gray-level value X_IN. In this case, the coordinate values of the thus-selected control points are forwarded to the V-T arithmetic processing circuit 12 in the form of the control point data 21.

After the coordinate values of the three control points are set to the V-T arithmetic processing circuit 12, the V-T arithmetic processing circuit 12 calculates the gray-level value of the corrected display data 22 (hereinafter, "output gray-level value") corresponding to the input gray-level value X_IN. The output gray-level value Y_OUT is calculated as the Y-coordinate value of a point having the X-coordinate value X_IN in the quadratic Bezier curve specified by the three control points. In FIG. 3, Steps S03 to S06 correspond to an algorithm for calculating the output gray-level value Y_OUT.

Figure 4:
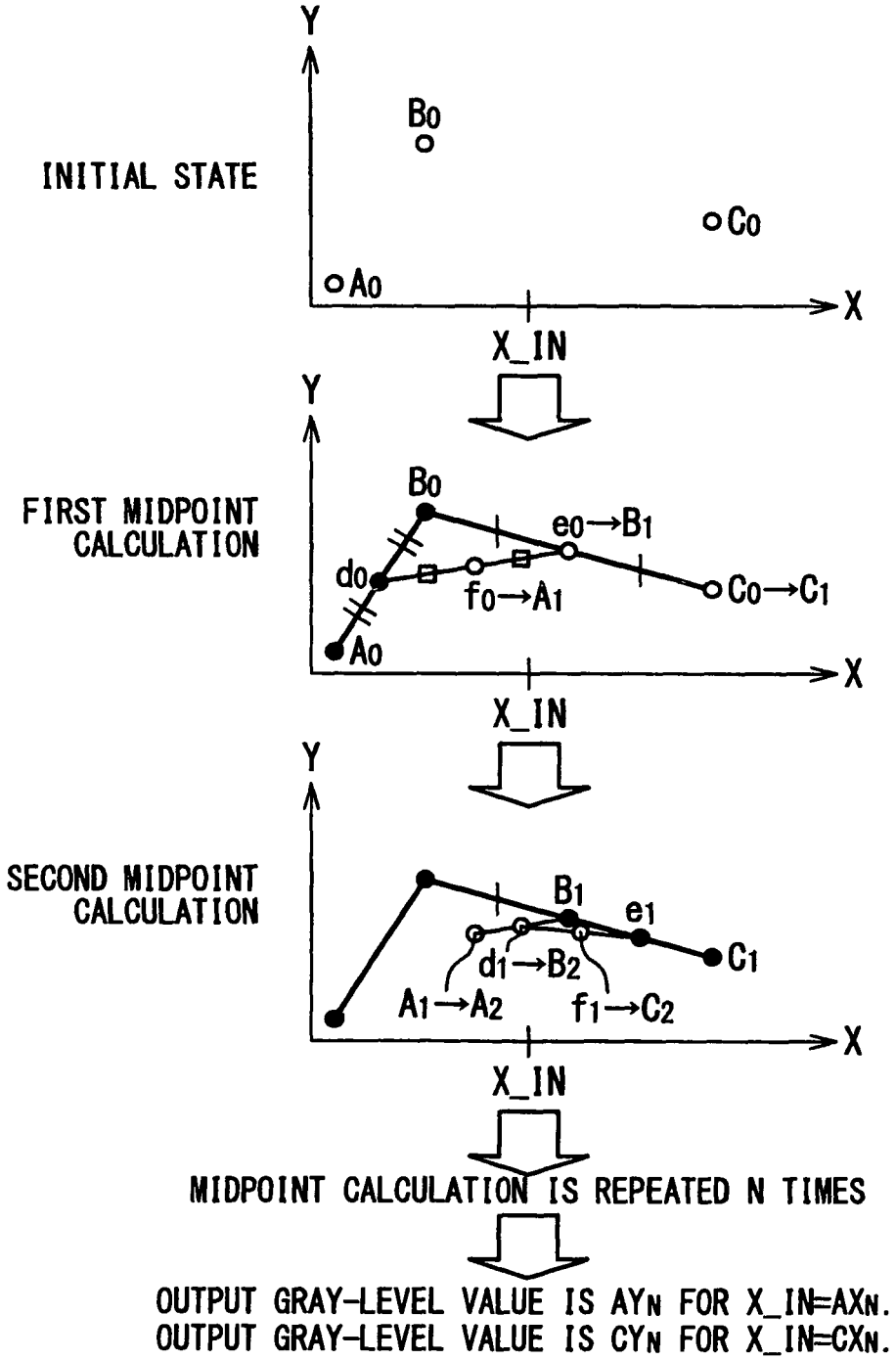
FIG. 4 is a conceptual diagram showing the gamma correction operation algorithm in one embodiment of the present invention.

FIG. 4 is a diagram showing the concept of the algorithm for calculating the output gray-level value Y_OUT in this embodiment. In FIG. 4, three control points initially set to the V-T arithmetic processing circuit 12 are denoted by symbols $A_O$, $B_O$, and $C_O$, respectively. When the CP selection area #j is selected (that is, the control points CP(2*j*−2), CP(2*j*−1), and CP(2*j*) are selected), coordinate values of the points $A_O$, $B_O$, and $C_O$ are expressed as follows, respectively:

$$A_O(AX_O,AY_O)=(CPX_{2j-2},CPY_{2j-2})$$

$$B_O(BX_O,BY_O)=(CPX_{2j-1},CPY_{2j-1}),\text{ and}$$

$$C_O(CX_O,CY_O)=(CPX_{2j},CPY_{2j}),$$

where $CPX_k$ is the X-coordinate value of the control point CPk and $CPY_k$ is the Y-coordinate value of the control point CPk.

As described below, the output gray-level value Y_OUT is calculated by repeating an operation for calculating one or more midpoints. One unit of these repetitive operations is referred to as "midpoint calculation", hereinafter. Furthermore, each midpoint between two adjacent control points among the three control points may be referred to as "first order midpoint" and that between two first order midpoints may be referred to as "second order midpoint".

In the first midpoint calculation, a first order midpoint $d_O$ which is the midpoint between the control points $A_O$ and $B_O$, and a first order midpoint $e_O$ which that is the midpoint between the control points $B_O$ and $C_O$, are calculated, and a second order midpoint $f_O$ that is the midpoint between the first order midpoints $d_O$ and $e_O$ is further calculated. The midpoint $f_O$ is in the desired gamma curve (that is a quadric Bezier curve specified by the three control points $A_O$, $B_O$, and $C_O$). The coordinates ($Xf_O$, $Yf_O$) of the second order midpoint $f_O$ are expressed by the following equations, respectively:

$$Xf_O=(AX_O+2BX_O+CX_O)/4,\text{ and}$$

$$Yf_O=(AY_O+2BY_O+CY_O)/4.$$

Three control points: points $A_1$, $B_1$, and $C_1$ used in the next midpoint calculation (second midpoint calculation) are selected from among the control point $A_O$, the first order midpoint $d_O$, the second order midpoint $f_O$, the first order midpoint $e_O$, and the control point $B_O$ in accordance with a result of comparison of the input gray-level value X_IN with the X-coordinate value $X_{fO}$ of the second order midpoint $f_O$. More specifically, the points $A_1$, $B_1$, and $C_1$ are selected as follows:

(A) For $X_{fO}\geq$X_IN, leftmost three points having smaller X-coordinate values: the control point $A_O$, the first order midpoint $d_O$, and the second order midpoint $f_O$ are selected as the control points $A_1$, $B_1$, and $C_1$, respectively. That is, it holds:

$$A_1=A_O,\ B_1=d_O,\text{ and } C_1=f_O. \tag{1a}$$

(B) For $X_{fO}<$X_IN, rightmost three points having larger X-coordinate values: the second order midpoint $f_O$, the first order midpoint $e_O$, and point $C_O$ are selected as the control points $A_1$, $B_1$, and $C_1$, respectively. That is, it holds:

$$A_1=f_O,\ B_1=e_O,\text{ and } C_1=C_O. \tag{1b}$$

The second midpoint calculation is performed by the similar procedure. A first order midpoint $d_1$ that is the midpoint between the control points $A_1$ and $B_1$ and a first order midpoint $e_1$ that is the midpoint between the control points $B_1$ and $C_1$ are calculated, and a second order midpoint $f_1$ that is the midpoint between the first order midpoints $d_1$ and $e_1$ is further calculated. The second order midpoint $f_1$ is in the desired gamma curve. Moreover, three control points: points $A_2$; $B_2$, and $C_2$ are selected from among the control point $A_1$, the first order midpoint $d_1$, the second order midpoint $f_1$, the first order midpoint $e_1$, and the control point $B_1$ in accordance with a result of comparison of the input gray-level value X_IN with the X-coordinate value $X_{f1}$ of the second order midpoint $f_1$.

Such midpoint calculation is repeatedly performed a desired number of times with the similar procedure.

In summary, as shown in FIG. 3, the following operation is performed in the i-th midpoint calculation (steps S03 to S05):

(A) For $(AX_{i-1}+2BX_{i-1}+CX_{i-1})/4\geq$X_IN, $$AX_i=AX_{i-1}, \tag{2a}$$

$$BX_i=(AX_{i-1}+BX_{i-1})/2, \tag{3a}$$

$$CX_i=(AX_{i-1}+2BX_{i-1}+CX_{i-1})/4, \tag{4a}$$

$$AY_i=AY_{i-1}, \tag{5a}$$

$$BY_i=(AY_{i-1}+BY_{i-1})/2,\text{ and} \tag{6a}$$

$$CY_i=(AY_{i-1}+2BY_{i-1}+CY_{i-1})/4. \tag{7a}$$

(B) For $(AX_{i-1}+2BX_{i-1}+CX_{i-1})/4<$X_IN, $$AX_i=(AX_{i-1}+2BX_{i-1}+CX_{i-1})/4, \tag{2b}$$

$$BX_i=(BX_{i-1}+CX_{i-1})/2, \tag{3b}$$

$$CX_i=CX_{i-1}, \tag{4b}$$

$$AY_i=(AY_{i-1}+2BY_{i-1}+CY_{i-1})/4, \tag{5b}$$

$$BY_i=(BY_{i-1}+CY_{i-1})/2,\text{ and} \tag{6b}$$

$$CY_i=CY_{i-1}. \tag{7b}$$

It would be obvious for the person skilled in the art that the equal sign may be attached to either the inequality sign defined in condition (A) or that in condition (B).

Each midpoint calculation makes the control points $A_i$, $B_i$ and $C_i$ closer to the gamma curve and also makes the X-coordinate values of the control points $A_i$, $B_i$ and $C_i$ closer to the input gray-level value X_IN. The output gray-level value Y_OUT to be calculated finally is obtained from the Y-coordinate value of at least one of points $A_N$, $B_N$ and $C_N$ obtained by the N-th midpoint calculation. For example, the output gray-level value Y_OUT may be determined as the Y-coordinate value of one point selected arbitrarily from among the points $A_N$, $B_N$, and $C_N$. Alternatively, the output gray-level value Y_OUT may be determined as the average value of the Y-coordinate values of the points $A_N$, $B_N$ and $C_N$.

The number of times N of the midpoint calculations to be performed is preferably equal to or larger than the number of bits of the input gray-level value X_IN. That is, when the input gray-level value X_IN is N-bit data, it is preferable to perform the midpoint calculations N times or more. In this case, after the N-th midpoint calculation, the difference between the X-coordinate values of the points $A_N$ and $C_N$ is one, and one of the X-coordinate values of the points $A_N$ and $C_N$ coincides with the input gray-level value X_IN (At this time, the X-coordinate value of the point $B_N$ also coincides with one of the X-coordinate values of the points $A_N$ and $C_N$). Therefore, the output gray-level value Y_OUT is preferably selected as follows:

(a) For $X_IN=AX_N$, $$Y_OUT=AY_N, \text{ and}$$

(b) For $X_IN=CX_N$, $$Y_OUT=CY_N.$$

One may consider that the technique stated above is similar to a commonly-known algorithm for calculating a Bezier curve which is disclosed in, for example, Japanese Patent Application Publication No. H05-250479 A. One important difference between the gamma correction operation of this embodiment and an commonly-known Bezier curve calculation algorithm is that the calculation of the commonly-known Bezier curve calculation involves calculation of the X and Y-coordinate values of points in the Bezier curve for a ratio t at which each division point divides a segment connecting adjacent control points or a segment connecting adjacent division points. That is, the commonly known Bezier curve calculation operation involves calculation of coordinates of a point (X, Y) in the Bezier curve by using equations in which t is used as a parameter. However, such calculation operation, however, is not suited for the gamma correction operation. This is because the gamma correction operation requires calculating the Y-coordinate value (output gray-level value) corresponding to a desired X-coordinate value (input gray-level value). For example, if a commonly known ordinary Bezier curve calculation operation is applied to the gamma correction operation, an operation for calculating the value of the parameter t corresponding to the input gray-level value is additionally required. In this embodiment, by contrast, operations are repeatedly performed only in an operation range near the input gray-level value X_IN while narrowing the operation range, and the output gray-level value Y_OUT is calculated for the specific input gray-level value X_IN.

The above-stated operation may be performed with hardware, software, or a combination of hardware and software. It should be noted, however, that it is preferable to perform the gamma correction operation in the controller driver 4 with dedicated hardware, since the gamma correction operation is desired to be performed in real time.

Figure 5:
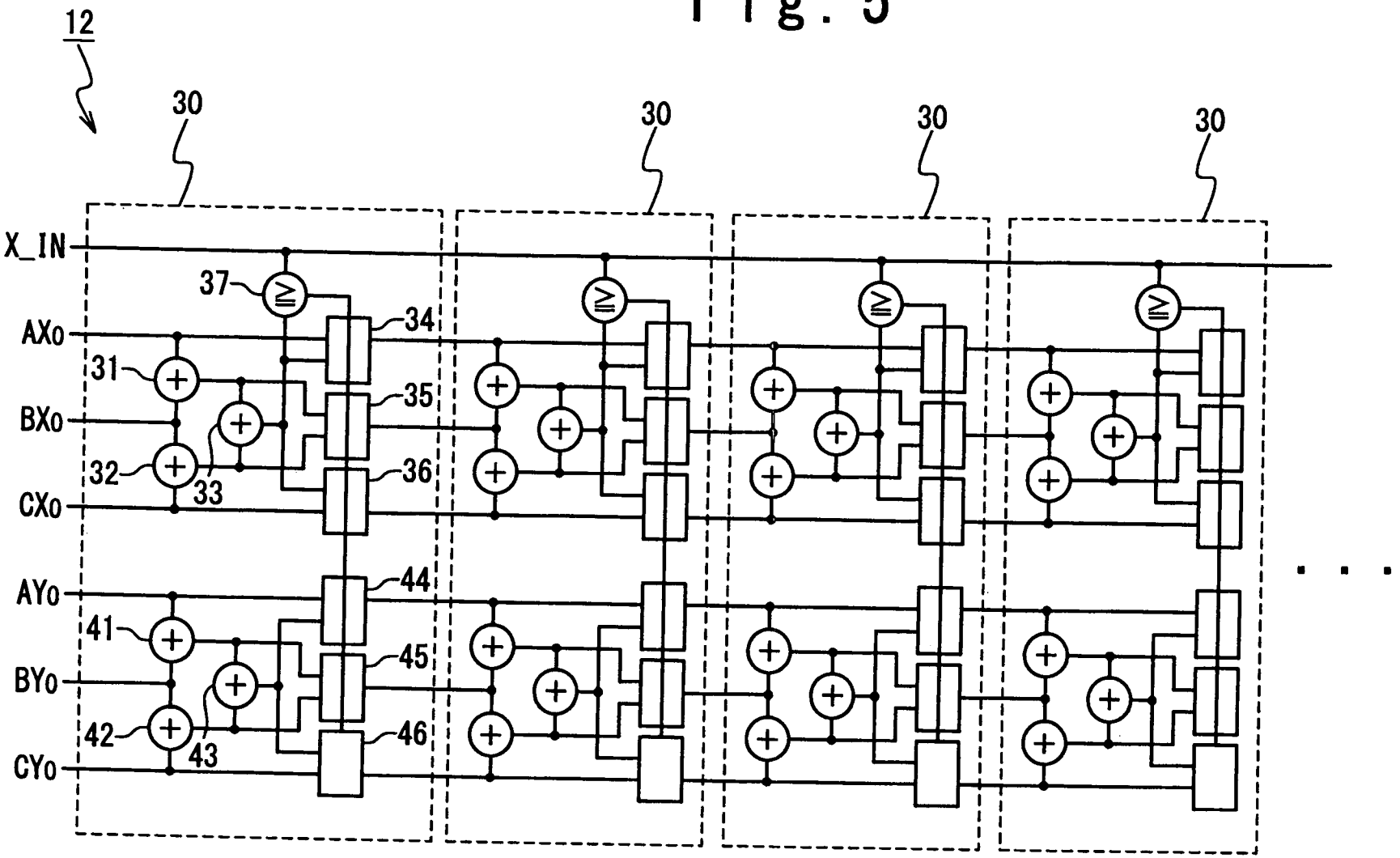
FIG. 5 is a circuit diagram showing an exemplary configuration of a V-T arithmetic processing circuit implementing the algorithm shown in FIG. 4.

FIG. 5 is a circuit diagram showing a preferred configuration of the V-T arithmetic processing circuit 12 which achieves the gamma correction operation with dedicated hardware. As shown in FIG. 5, the V-T arithmetic processing circuit 12 includes unit operation stages 30 connected in series. Each unit operation stage 30 is configured to perform the midpoint calculation stated above. That is, midpoint calculations are repeatedly performed by connecting the unit operation stages 30 in series.

Figure 6:
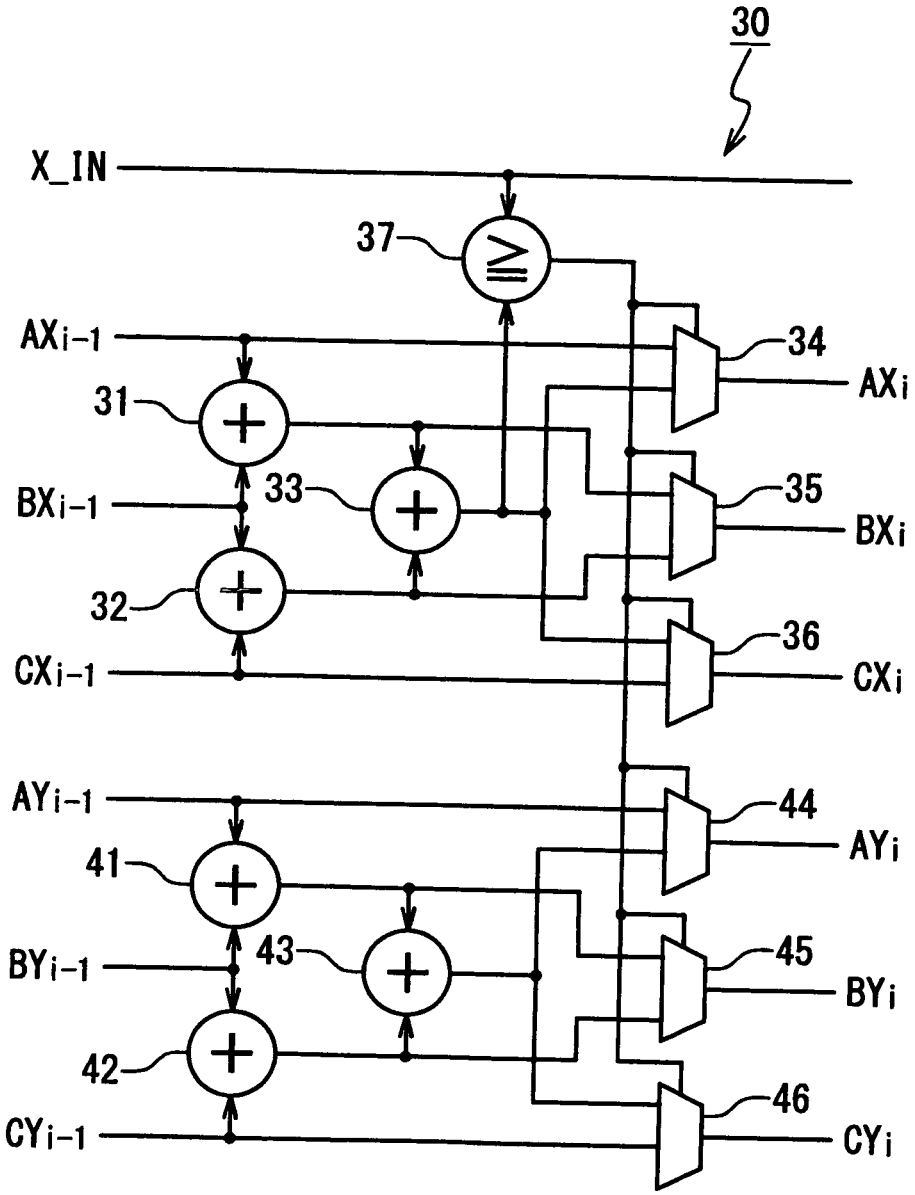
FIG. 6 is a circuit diagram showing an exemplary configuration of a unit operation stage in the V-T arithmetic processing circuit shown in FIG. 5.

FIG. 6 is a circuit diagram showing an exemplary configuration of the unit operation stage 30. Each unit operation stage 30 includes adders 31 to 33, selectors 34 to 36, a comparator 37, adders 41 to 43, and selectors 44 to 46. The adders 31 to 33 and the selectors 34 to 36 are used to calculate for X-coordinate values of the points $A_{i-1}$, $B_{i-1}$, and $C_{i-1}$. The adders 41 to 43 and the selectors 44 to 46 are used to calculate Y-coordinate values of the points $A_{i-1}$, $B_{i-1}$, and $C_{i-1}$.

Each unit operation stage 30 includes seven input terminals, one of which are fed with the input gray-level value, and the others are fed with X-coordinate values $BX_{i-1}$ and $CX_{i-1}$ and Y-coordinate values $AY_{i-1}$, $BY_{i-1}$ and $CY_{i-1}$ of the points $A_{i-1}$, $B_{i-1}$ and respectively. The adder 31 has a first input connected to the input terminal of the unit operation stage 30 to which the X-coordinate value $AX_{i-1}$ is supplied and a second input connected to the input terminal thereof to which the X-coordinate value $BX_{i-1}$ is supplied. The adder 32 has a first input connected to the input terminal of the unit operation stage 30 to which the X-coordinate value $BX_{i-1}$ is supplied and a second input connected to the input terminal thereof to which the X-coordinate value $CX_{i-1}$ is supplied. The adder 33 has a first input connected to the output of the adder 31 and a second input connected to the output of the adder 32.

Correspondingly, the adder 41 has a first input connected to the input terminal of the unit operation stage 30 to which the Y-coordinate value $AY_{i-1}$ is supplied and a second input connected to the input terminal thereof to which the Y-coordinate value $BY_{i-1}$ is supplied. The adder 42 has a first input connected to the input terminal of the unit operation stage 30 to which the Y-coordinate value $BY_{i-1}$ is supplied and a second input connected to the input terminal thereof to which the Y-coordinate value $CY_{i-1}$ is supplied. The adder 43 has a first input connected to an output of the adder 41 and a second input connected to an output of the adder 42.

The comparator 37 has a first input to which the input gray-level value X_IN is supplied and a second input connected to an output of the adder 33.

The selector 34 has a first input connected to the input terminal of the unit operation stage 30 to which the X-coordinate value $AX_{i-1}$ is supplied and a second input connected to the output of the adder 33, and selects the first or second input in response to the output value from the comparator 37. The output of the selector 34 is connected to the output terminal of the unit operation stage 30 from which the X-coordinate value $AX_i$ is outputted. Correspondingly, the selector 35 has a first input connected to the output of the adder 31 and a second input connected to the output of the adder 32, and selects the first or second input in response to the output value from the comparator 37. The output of the selector 35 is connected to the output terminal of the unit operation stage 30 from which the X-coordinate value $BX_i$ is outputted. Further, the selector 36 has a first input connected to the output of the adder 33 and a second input connected to the input terminal of the unit operation stage 30 to which the X-coordinate value $C_{i-1}$ is supplied, and selects the first or second input in response to the output value from the comparator 37. The output of the selector 36 is connected to the output terminal of the unit operation stage 30 from which the X-coordinate value $CX_i$ is outputted.

The similar goes for the selectors 41 to 43. The selector 44 has a first input connected to the input terminal of the unit operation stage 30 to which the Y-coordinate value $AY_{i-1}$ is supplied and a second input connected to the output of the adder 43, and selects the first or second input in response to an output value from the comparator 37. The output of the selector 44 is connected to the output terminal of the unit operation stage 30 from which the Y-coordinate value $AY_i$ is outputted. Correspondingly, the selector 45 has a first input connected to the output of the adder 31 and a second input connected to the output of the adder 42, and selects the first or second input in response to the output value from the comparator 37. The output of the selector 45 is connected to the output terminal of the unit operation stage 30 from which the Y-coordinate value $BY_i$ is outputted. Further, the selector 46 has a first input connected to the output of the adder 43 and a second input connected to the input terminal of the unit operation stage 30 to which the Y-coordinate value $CY_{i-1}$ is supplied, and selects the first or second input in response to the output value from the comparator 37. The output of the selector 46 is connected to the output terminal of the unit operation stage 30 from which the Y-coordinate value $CY_i$ is outputted.

In each unit operation stage 30 thus configured, the adder 31 performs the operation expressed by Equation (3a) presented above, the adder 32 performs the operation expressed by Equation (3b), and the adder 33 performs the operation expressed by (4a) and (2b) using the output values from the adders 31 and 32. Correspondingly, the adder 41 performs the operation expressed by Equation (6a), the adder 42 performs the operation expressed by Equation (6b), and the adder 43 performs the operation expressed by Equations (7a) and (5b) using the output values from the adders 41 and 42. The comparator 37 compares the output value from the adder 33 with the input gray-level value X_IN, and instructs the selectors 34 to 36 and 44 to 46 to output selected one of the two input values fed thereto, respectively. When the input gray-level value X_IN is smaller than $(AX_{i-1}+2BX_{i-1}+CX_{i-1})/4$, then the selector 34 selects the selector 35 selects the output value from the adder 31, the selector 36 selects the output value from the adder 33, the selector 44 selects $AY_{i-1}$, the selector 45 selects the output value from the adder 41, and the selector 46 selects the output value from the adder 43. When the input gray-level value X_IN is larger than $(AX_{i-1}+2BX_{i-1}+CX_{i-1})/4$, then the selector 34 selects the output value from the adder 33, the selector 35 selects the output value from the adder 32, the selector 36 selects the $CX_{i-1}$, the selector 44 selects the output value from the adder 43, the selector 45 selects the output value from the adder 42, and the selector 46 selects $CY_{i-1}$. The values selected by the selectors 34 to 36 and 44 to 46 are supplied to the next unit operation stage 36 as $AX_i$, $BX_i$, $CX_i$, $AY_i$, $BY_i$, and $CY_i$, respectively.

It should be noted here that divisions included in Equations (2a) to (7a) and (2b) to (7b) can be realized by rounding down one or more lower bits. Most simply, desired division operations can be realized by rounding down the lowest bit of the output values from the adders 31 to 33 and 41 to 43. In this case, one bit is rounded down on each of the output terminals of the adders 31 to 33 and 41 to 43. It should be noted, however, that the positions where the lower bits are rounded down in each unit calculation stage may be appropriately determined as long as operations equivalent to Equations (2a) to (7a) and (2b) to (2b) are achieved. For example, lower bits may be rounded down one the input terminals of the adders 31 to 33 and 41 to 43 or on the input terminals of the comparator 37 and the selectors 34 to 36 and 44 to 46.

The output gray-level value Y_OUT to b calculated can be finally obtained from at least one of $AY_N$, $BY_N$ and $CY_N$ outputted from the final unit operation stage 30 (that is, the unit operation stage 33 performing the N-th midpoint calculation) of the V-T arithmetic processing circuit 12 configured as stated above.

Although the above-described calculation of the output gray-level value Y_OUT is based on the method of expressing the gamma curve as the quadric Bezier curve the shape of which is specified by three control points, the gamma curve may be expressed as a degree three (cubic) or more Bezier curve, alternatively. In this alternative, N control points are initially given when the gamma curve is expressed as a degree-(N−1) Bezier curve and similar midpoint calculations are performed on the N control points to calculate the output gray-level value Y_OUT.

More specifically, when N control points are given, the midpoint calculation is performed as follows: First order midpoints are each calculated as a midpoint between two adjacent control points out of the N control points. The number of first order midpoints is N−1. Further, second order midpoints are each calculated as a midpoint between two adjacent ones out of the (N−1) first order midpoints. The number of second order midpoint is N−2. In the same way, (N−k−1) (k+1)-th order midpoints are each calculated as a midpoint between two adjacent k-th order midpoints out of (N−k) k-th order midpoints. This procedure is carried out until one (N−1)-th order midpoint is finally calculated. Hereinafter, the control point having the smallest X-coordinate value among the N control points is referred to as minimum control point and the control point having the largest X-coordinate value is referred to as maximum control point. Similarly, the k-th order midpoint having the smallest X-coordinate value out of the k-th order midpoints is referred to as k-th order minimum midpoint and the k-th order midpoint having the largest X-coordinate value is referred to as k-th order maximum midpoint. When the X-coordinate value of the (N−1)-th order midpoint is smaller than the input gray-level value X_IN, the minimum control point, first to (N−2)-th order minimum midpoints and the (N−1)-th order midpoint are selected as N control points for the next stage. When the X-coordinate value of the (N−1)-th order midpoint is larger than the input gray-level value X_IN, the (N−1)-th order midpoint, first to (N−2)-th order maximum midpoints and the maximum control point are selected as N control points for the next stage. The above-stated midpoint operation addresses the case where N=3.

For easy understanding of such generalization, a description is given below of midpoint calculation for the case where N=4 (that is, the case where a cubic Bezier curve is used to express the gamma curve) will. The coordinates of four control points $A_O$, $B_O$, $C_O$, and $D_O$ are referred to as $(AX_O, AY_O)$, $(BX_O, BY_O)$, $(CX_O, CY_O)$, and $(DX_O, DY_O)$, respectively. In this case, the coordinate values of the four control points $A_O$, $B_O$, $C_O$, and $D_O$ can be determined in accordance with the area which the input gray-level value X_IN belongs similarly to the instance of N=3.

Figure 7:
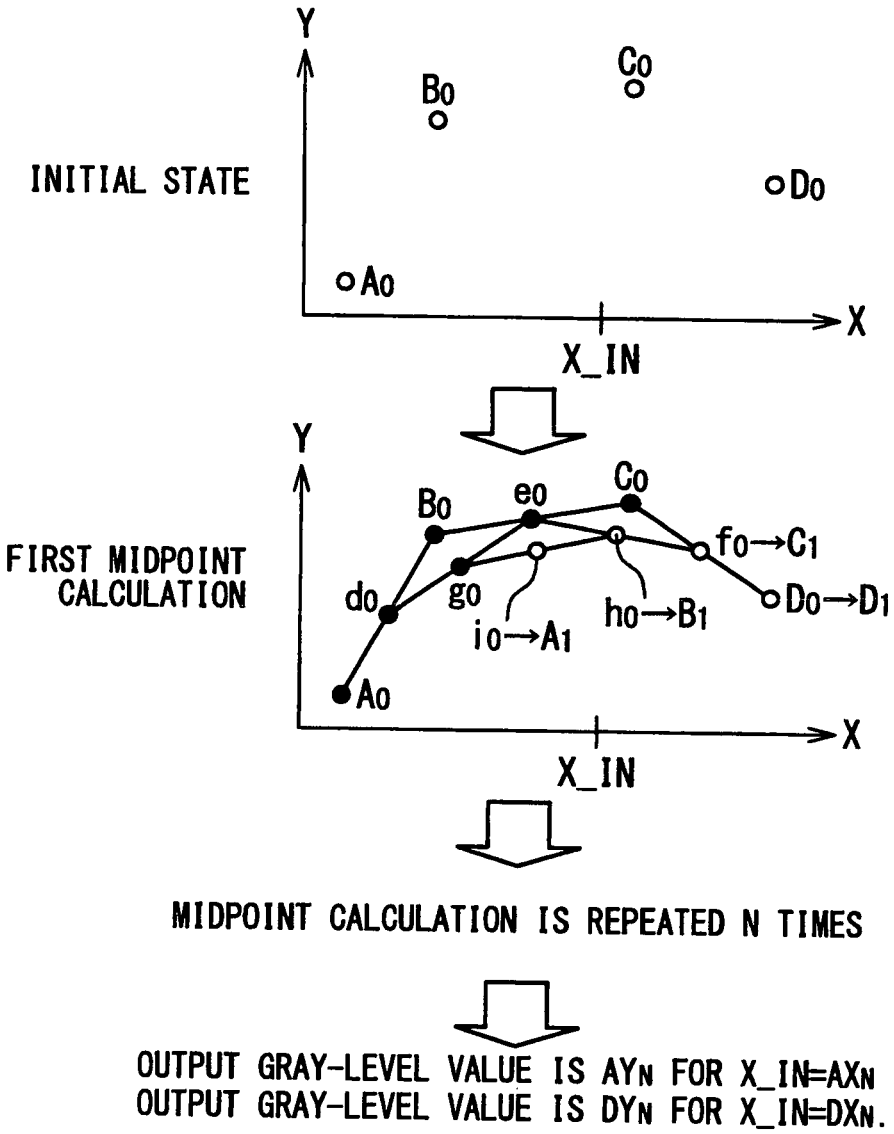
FIG. 7 is a conceptual diagram showing a gamma correction operation algorithm in another embodiment of the present invention.

FIG. 7 is a diagram schematically showing the midpoint calculation for N=4 (that is, for the case where the cubic Bezier curve is used to express the gamma curve). Initially, four control points $A_O$, $B_O$, $C_O$, and $D_O$ are given. It should be noted that the control point $A_O$ is the minimum control point and $D_O$ is the maximum control point. In the first midpoint calculation, a first order midpoint $d_O$ that is the midpoint between the control points $A_O$ and $B_O$, a first order midpoint $e_O$ that is the midpoint between the control points $B_O$ and $C_O$, and a first order midpoint $f_O$ that is the midpoint between the control points $C_O$ and $D_O$ are calculated. It should be noted that $d_O$ is the 0 first order minimum midpoint and that $f_O$ is the first order maximum midpoint. Further, a second order midpoint $g_O$ that is the midpoint between the first order midpoints $d_O$ and $e_O$ and a second order midpoint $h_O$ that is the midpoint between the first order midpoints $e_O$ and $f_O$ are calculated. The midpoint $g_O$ is the second order minimum midpoint and $h_O$ is the. Furthermore, a third order midpoint $i_O$ that is a midpoint between the second order midpoints $g_O$ and $h_O$ is calculated. The third order midpoint $i_O$ is a point in the cubic Bezier curve specified by the four control points $A_O$, $B_O$, $C_O$ and $D_O$ and the coordinates ($X_{iO}$, $Y_{iO}$) of the third order midpoint $i_O$ are expressed by the following equations, respectively:

$$X_{iO}=(AX_O+3BX_O+3CX_O+DX_O)/8, \text{ and}$$

$$Y_{iO}=(AY_O+3BY_O+3CY_O+DY_O)/8.$$

Four control points: points $A_1$, $B_1$, $C_1$, and $D_1$ used in the next midpoint calculation (second midpoint calculation) are selected according to the result of comparison of the input gray-level value X_IN with the X-coordinate value $X_{iO}$ of the third-order midpoint $i_O$. More specifically, for $X_{iO} \leq$ X_IN, the minimum control point $A_O$, the first order minimum midpoint $d_O$, the second order minimum midpoint $f_O$, and the third order midpoint $e_O$ are selected as the control points $A_1$, $B_1$, $C_1$ and $D_1$, respectively. For $X_{iO}<$ X_IN, on the other hand, the third order midpoint $e_O$, the second order maximum midpoint $h_O$, the first order maximum midpoint $f_O$, and the maximum control point $D_O$ are selected as the points $A_1$, $B_1$, $C_1$ and $D_1$, respectively.

The second and subsequent midpoint calculations are performed by the similar procedure. Generally, the following operation is performed in the i-th midpoint calculation:

(A) For $(AX_{i-1}+3BX_{i-1}+3CX_{i-1}+DX_{i-1})/8 \geq$ X_IN, $$AX_i=AX_{i-1}, \tag{2a'}$$

$$BX_i=(AX_{i-1}+BX_{i-1})/2, \tag{3a'}$$

$$CX_i=(AX_{i-1}+2BX_{i-1}+CX_{i-1})/4, \tag{4a'}$$

$$DX_i=(AX_{i-1}+3BX_{i-1}+3CX_{i-1}+DX_{i-1})/8, \tag{5a'}$$

$$AY_i=AY_{i-1}, \tag{6a'}$$

$$BY_i=(AY_{i-1}+BY_{i-1})/2, \tag{7a'}$$

$$CY_i=(AY_{i-1}+2BY_{i-1}+CY_{i-1})/4, \text{ and} \tag{8a'}$$

$$DY_i=(AY_{i-1}+3BY_{i-1}+3CY_{i-1}+DY_{i-1})/8. \tag{9a'}$$

(B) For $(AX_{i-1}+3BX_{i-1}+3CX_{i-1}+DX_{i-1})/8<$ X_IN, $$AX_i=(AX_{i-1}+3BX_{i-1}+3CX_{i-1}+DX_{i-1})/8, \tag{2b'}$$

$$BX_i=(BX_{i-1}+2BX_{i-1}+DX_{i-1})/4, \tag{3b'}$$

$$CX_i=(CX_{i-1}+DX_{i-1})/2, \tag{4b'}$$

$$DX_i=DX_{i-1}, \tag{5b'}$$

$$AX_i=(AX_{i-1}+3BX_{i-1}+3CX_{i-1}+DX_{i-1})/8$$

$$BY_i=(BY_{i-1}+2CY_{i-1}+DY_{i-1})/4, \tag{6b'}$$

$$CY_i=(CY_{i-1}+DY_{i-1})/2, \text{ and} \tag{7b'}$$

$$DY_i=DY_{i-1}. \tag{8b'}$$

It would be obvious for the person skilled in the art that the equal sign may be attached to either the inequality sign defined in condition (A) or that in condition (B).

Each midpoint calculation makes the control points $A_i$, $B_i$, $C_i$, and $D_i$ closer to the gamma curve and also makes the X-coordinate values of the control points $A_i$, $B_i$, $C_i$ and $D_i$ closer to the input gray-level value X_IN. The output gray-level value Y_OUT to be calculated finally is obtained from the Y-coordinate value of at least one of points $A_N$, $B_N$, $C_N$ and $D_N$ obtained by the N-th midpoint calculation. For example, the output gray-level value Y_OUT may be determined as the Y-coordinate value of one point selected arbitrarily from among the points $A_N$, $B_N$, $C_N$ and $D_N$. Alternatively, the output gray-level value Y_OUT may be determined as the average value of the Y-coordinate values of the points $A_N$, $B_N$, $C_N$ and $D_N$.

The number of times N of the midpoint calculations to be performed is preferably equal to or larger than the number of bits of the input gray-level value X_IN. That is, for a case where the input gray-level value X_IN is N-bit data, it is preferable to perform midpoint calculations N times or more. In this case, after the N-th midpoint calculation, a difference between the X-coordinate values of the points $A_N$ and $D_N$ is one and one of the X-coordinate values of the points $A_N$ and $D_N$ coincides with the input gray-level value X_IN (At this time, the X-coordinate values of the points $B_N$ and $C_N$ also coincide with one of the X-coordinate values of the points $A_N$ and $D_N$). Accordingly, the output gray-level value Y_OUT is preferably selected as follows:

(a) For X_IN=$AX_N$, $$Y_OUT=AY_N.$$

(b) For X_IN=$DX_N$, $$Y_OUT=DY_N.$$

Figure 8:
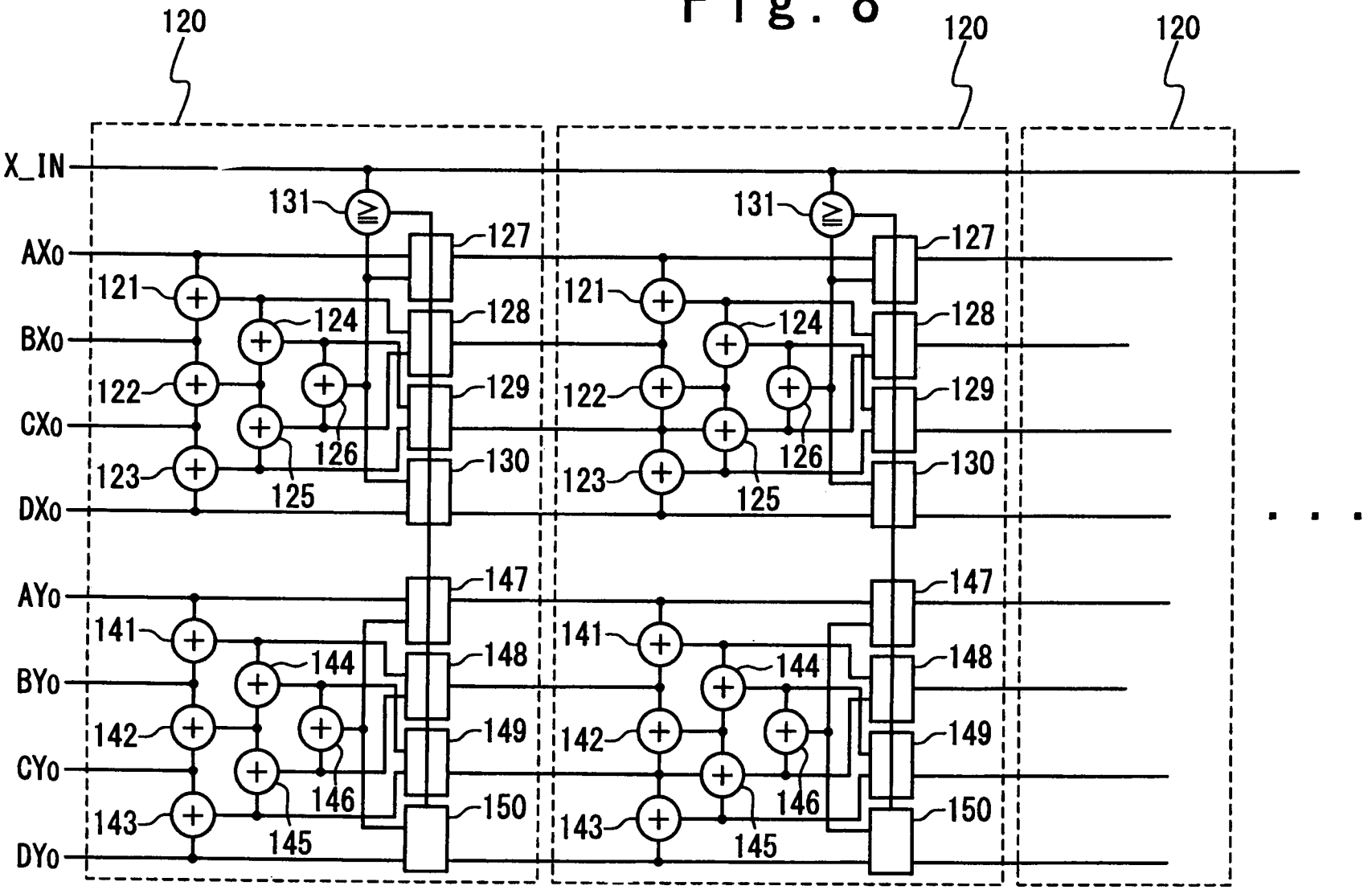
FIG. 8 is a circuit diagram showing a V-T arithmetic processing circuit implementing the algorithm shown in FIG. 7.

The above-stated operation may be performed with hardware, software, or a combination of hardware and software. FIG. 8 is a circuit diagram showing a preferred configuration of the V-T arithmetic processing circuit 12 when the gamma correction operation is realized by dedicated hardware. As shown in FIG. 8, the V-T arithmetic processing circuit 12 includes unit operation stages 120 connected in series. Each unit operation stage 120 is configured to perform the midpoint calculation stated above. That is, midpoint calculations are repeatedly performed by connecting the unit operation stages 120 in series.

Each unit operation stage 120 includes adders 121 to 126, selectors 127 to 130, a comparator 131, adders 141 to 146, and selectors 147 to 149. The adders 121 to 126 and the selectors 127 to 130 are used to calculate X-coordinate values of the points $A_{i-1}$, $B_{i-1}$, $C_{i-1}$ and $D_{i-1}$. The adders 41 to 43 and selectors 44 to 46 are used to calculate Y-coordinate values of the points $A_{i-1}$, $B_{i-1}$, $C_{i-1}$ and $D_{i-1}$.

Each unit operation stage 120 includes nine input terminals; the input gray-level value X_IN is inputted to one of the input terminals, and the X-coordinate values $AX_{i-1}$, $BX_{i-1}$, $CX_{i-1}$ and $DX_{i-1}$ and the Y-coordinate values $AY_{i-1}$, $BY_{i-1}$, $CY_{i-1}$ and $DY_{i-1}$ of the points $A_{i-1}$, $B_{i-1}$, $C_{i-1}$ and $D_{i-1}$ are supplied to the other eight terminals thereof, respectively. The adder 121 has a first input connected to the input terminal of the unit operation stage 120 to which the X-coordinate value $AX_{i-1}$ is supplied and a second input connected to the input terminal thereof to which the X-coordinate value $BX_{i-1}$ is supplied. The adder 122 has a first input connected to the input terminal of the unit operation stage 120 to which the X-coordinate value $BX_{i-1}$ is supplied and a second input connected to the input terminal thereof to which the X-coordinate value $CX_{i-1}$ is supplied. The adder 123 has a first input connected to the input terminal of the unit operation stage 120 to which the X-coordinate value $CX_{i-1}$ is supplied and a second input connected to the input terminal thereof to which the X-coordinate value $DX_{i-1}$ is supplied. The adder 124 has a first input connected to the output of the adder 121 and a second input connected to the output of the adder 122. The adder 125 has a first input connected to the output of the adder 122 and a second input connected to the output of the adder 123. The adder 126 has a first input connected to the output of the adder 124 and a second input connected to the output of the adder 125.

Correspondingly, the adder 141 has a first input connected to the input terminal of the unit operation stage 120 to which the Y-coordinate value $AY_{i-1}$ is supplied and a second input connected to the input terminal thereof to which the Y-coordinate value $BY_{i-1}$ is supplied. The adder 142 has a first input connected to the input terminal of the unit operation stage 120 to which the Y-coordinate value $BY_{i-1}$ is supplied and a second input connected to the input terminal thereof to which the Y-coordinate value $CY_{i-1}$ is supplied. The adder 143 has a first input connected to the input terminal of the unit operation stage 120 to which the Y-coordinate value $CY_{i-1}$ is supplied and a second input connected to the input terminal thereof to which the Y-coordinate value $DY_{i-1}$ is supplied. The adder 144 has a first input connected to the output of the adder 141 and a second input connected to an output of the adder 142. The adder 145 has a first input connected to the output the adder 142 and a second input connected to an output of the adder 143. The adder 146 has a first input connected to the output of the adder 144 and a second input connected to the output of the adder 145.

The comparator 131 has a first input to which the input gray-level value X_IN is supplied and a second input connected to the output of the adder 126.

The selector 127 has a first input connected to the input terminal of the unit operation stage 120 to which the X-coordinate value $AX_{i-1}$ is supplied and a second input connected to the output of the adder 126, and selects the first or second input in response to the output value from the comparator 131. The output of the selector 127 is connected to the output terminal of the unit operation stage 120 from which the X-coordinate value $AX_i$ is outputted. Similarly, the selector 128 has a first input connected to the output of the adder 121 and a second input connected to the output of the adder 125, and selects the first or second input in response to the output value from the comparator 131. The output of the selector 128 is connected to the output terminal of the unit operation stage 120 from which the X-coordinate value $BX_i$ is outputted. Further, the selector 129 has a first input connected to the output of the adder 124 and a second input connected to the'output of the adder 123, and selects the first or second input in response to the output value from the comparator 131. The output of the selector 129 is connected to the output terminal of the unit operation stage 120 from which the X-coordinate value $CX_i$ is outputted. Moreover, the selector 130 has a first input connected to the output of the adder 126 and a second input connected to the input terminal of the unit operation stage 120 to which the X-coordinate value $DX_{i-1}$ is supplied, and selects the first or second input in response to the output value from the comparator 131. The output of the selector 130 is connected to the output terminal of the unit operation stage 120 from which the X-coordinate value $DX_i$ is outputted.

The selector 147 has a first input connected to the input terminal of the unit operation stage 120 to which the Y-coordinate value $AY_{i-1}$ is supplied and a second input connected to the output of the adder 146, and selects the first or second input in response to the output value from the comparator 131. The output of the selector 147 is connected to the output terminal of the unit operation stage 120 from which the Y-coordinate value $AY_i$ is outputted. Similarly, the selector 148 has a first input connected to the output of the adder 141 and a second input connected to the output of the adder 145, and selects the first or second input in response to the output value from the comparator 131. The output of the selector 148 is connected to the output terminal of the unit operation stage 120 from which the Y-coordinate value $BY_i$ is outputted. Further, the selector 149 has a first input connected to the output of the adder 144 and a second input connected to the output of the adder 143, and selects the first or second input in response to the output value from the comparator 131. The output of the selector 149 is connected to the output terminal of the unit operation stage 120 from which the Y-coordinate value $CY_i$ is outputted. Moreover, the selector 150 has a first input connected to the output of the adder 146 and a second input connected to the input terminal of the unit operation stage 120 to which the Y-coordinate value $DY_{i-1}$ is supplied, and selects the first or second input in response to the output value from the comparator 131. The output of the selector 150 is connected to the output terminal of the unit operation stage 120 from which the Y-coordinate value $DY_i$ is outputted.

The person skilled in the art would readily understand that the unit operation stage 120 configured as shown in FIG. 8 performs the operations expressed by Equations (2a') to (9a') and (2b') to (9b').

Each unit operation stage 30 shown in FIG. 6 includes six adders, six selectors and one comparator, and each unit operation stage 120 shown in FIG. 8 includes 12 adders, eight selectors and one comparator. It should be noted that optimization of the algorithm for calculating the output gray-level value Y_OUT allows decreasing the number of operation units and the number of bits of values processed by the respective operations. A description is given of an improved algorithm for calculating the output gray-level value Y_OUT.

Figure 9:
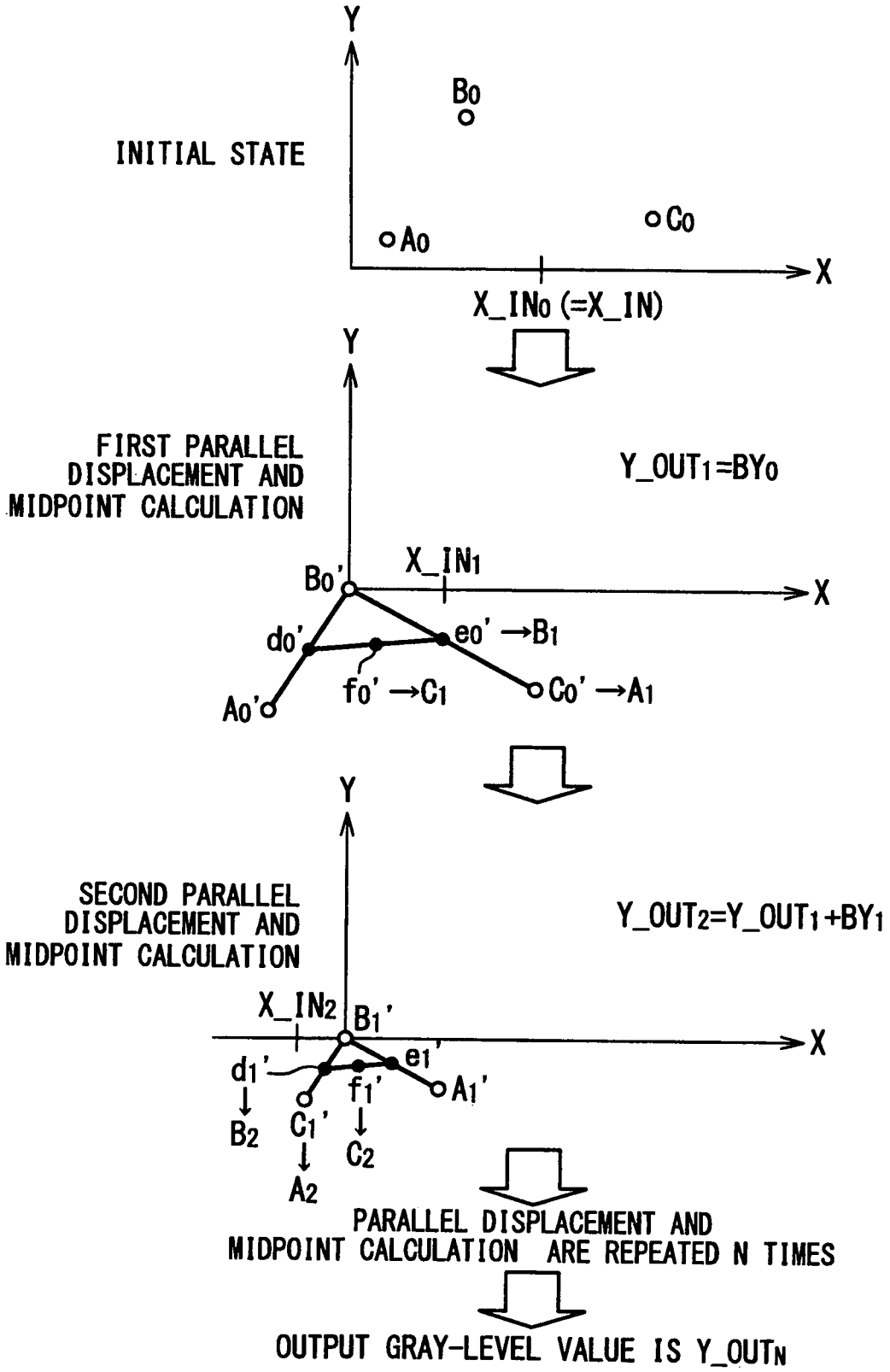
FIG. 9 is a conceptual diagram showing a gamma correction operation algorithm in still another embodiment of the present invention.

FIG. 9 is a conceptual diagram showing the improved algorithm for calculating the output gray-level value Y_OUT when the gamma curve is expressed with the quadric Bezier curve. In the algorithm of FIG. 9, each midpoint calculation is accompanied with parallel displacement operation; the points $A_{i-1}$, $B_{i-1}$ and $C_{i-1}$ are subjected to parallel displacement so that the point is shifted to the origin before the first order midpoints $d_{i-1}$ and $e_{i-1}$ the second order midpoint $f_{i-1}$ are calculated in the i-th midpoint calculation. In addition, the second order midpoint $f_{i-1}$ is always selected as the point $C_i$ used in the (i+1)-th midpoint calculation. The repetition of the parallel displacement and midpoint calculation effectively reduces the number of required operation units and the number of bits of the values processed by the respective operation units. Details of the algorithm of FIG. 9 will now be described in the following.

In the following description, the three control points $A_O$, $B_O$ and $C_O$ are assumed as being selected for the input gray-level value X_IN. For unifying terms, the initially given input gray-level value X_IN is referred to as target gray-level value $X_IN_O$.

In the first parallel displacement and midpoint calculation, the points $A_O$, $B_O$ and $C_O$ are translated so that the point $B_O$ is shifted to the origin after the parallel displacement. The points $A_O$, $B_O$ and $C_O$ after the parallel displacement are denoted by $A_O'$, $B_O'$ and $C_O'$, respectively. The point $B_O'$ coincides with the origin. Here, the coordinates of the points $A_O'$ and Co' are expressed as follows, respectively:

$$A_O'(AX_O',AY_O')=(AX_O-BX_O,AY_O-BY_O), \text{ and}$$

$$C_O'(CX_O',CY_O')=(CX_O-BX_O,CY_O-BY_O).$$

Concurrently, a parallel displacement distance $BX_O$ in the X-axis direction is subtracted from the target gray-level value $X_IN_O$ to obtain the target gray-level value $X_IN_1$ used in the next parallel displacement and midpoint calculation.

Next, a first order midpoint $d_O'$ between the points $A_O'$ and $B_O'$ and a first order midpoint $e_O'$ between the points $B_O'$ and $C_O'$ are calculated, and further a second order midpoint $f_O'$ between the first order midpoints $e_O'$ and $f_O'$ is calculated. The second order midpoint $f_O'$ is a point in the gamma curve subjected to such parallel displacement that the point $B_i$ is shifted to the origin (that is, the quadric Bezier curve specified by the three points $A_O'$, $B_O'$ and $C_O'$).

The coordinates ($X_{fO}'$, $Y_{fO}'$) of the second order midpoint $f_O'$ are expressed by the following Equation (10):

$$(X_{f0}', Y_{f0}') = \left(\frac{AX_0' + CX_0'}{4}, \frac{AY_0' + CY_0'}{4}\right), \quad (10)$$

$$= \left(\frac{(AX_0 - BX_0) + (CX_0 - BX_0)}{4}, \frac{(AY_0 - BY_0) + (CY_0 - BY_0)}{4}\right)$$

$$= \left(\frac{AX_0 - 2BX_0 + CX_0}{4}, \frac{AY_0 - 2BY_0 + CY_0}{4}\right).$$

The three control points: points $A_1$, $B_1$ and $C_1$ used in next parallel displacement and midpoint calculation (second parallel displacement and midpoint calculation) are selected from among the point $A_O'$, the first order midpoint $d_O'$, the second order midpoint $f_O'$, the first order midpoint $e_O'$ and the point $C_O'$ in accordance with the result of comparison of the target gray-level value $X_IN_1$ with the X-coordinate value $X_{fO}'$ of the second order midpoint $f_O'$. In this selection, the second order midpoint $f_O'$ is always selected as the point $C_1$ whereas the points $A_1$ and $B_1$ are selected as follows:

(A) For $X_{fO}' \geq X_IN_1$, leftmost two points having smaller X-coordinate values: the point $A_O'$ and the first order midpoint $d_O'$ are selected as the points $A_1$ and $B_1$, respectively. That is, $$A_1=A_O', B_1=d_O', \text{ and } C_1=f_O'. \quad (11a)$$

(B) For $X_{fO} < X_IN_1$, rightmost two points having larger X-coordinate values: the midpoint $C_O'$ and the first order midpoint $e_O'$ are selected as the points $A_1$ and $B_1$, respectively. That is, $$A_1=C_O', B_1=e_O', \text{ and } C_1=f_O'. \quad (11b)$$

Eventually, in the first parallel displacement and midpoint calculation, the following operations are performed:

$$X_IN_1=X_IN_O-B_{XO}, \quad (12)$$

$$X_{fO}'=(AX_O-2BX_O+CX_O)/4, \text{ and} \quad (13)$$

(A) for $X_{fO}' \geq X_IN_1$, $$AX_1=AX_O-BX_O, \quad (13a)$$

$$BX_1=(AX_O-BX_O)/2, \quad (14a)$$

$$CX_1=Xf_O'=(AX_O-2BX_O+CX_O)/4, \quad (15)$$

$$AY_1=AY_O-BY_O, \quad (16a)$$

$$BY_1=(AY_O-BY_O)/2, \text{ and} \quad (17a)$$

$$CY_1=Yf_O'=(AY_O-2BY_O+CY_O)/4, \quad (18)$$

(B) for $X_{fO}' < X_IN$, $$AX_1=CX_O-BX_O, \quad (13b)$$

$$BX_1=(CX_O-BX_O)/2, \quad (14b)$$

$$CX_1=(AY_O-2BY_O+CY_O)/4, \quad (15)$$

$$AY_1=CY_O-BY_O, \quad (16b)$$

$$BY_1=(CY_O-BY_O)/2, \text{ and} \quad (17b)$$

$$CY_1=(AY_O-2BY_O+CY_O)/4. \quad (18)$$

It would be obvious for the person skilled in the art that the equal sign may be attached to either the inequality sign defined in condition (A) or that in condition (B).

As understood from the Equations (13a), (14a), (13b) and (14b), the following relationship is established in both of the cases of (A) or (B):

$$AX_1=2BX_1, \text{ and} \quad (19)$$

$$AY_1=2BY_1. \quad (20)$$

This implies that there is no need to calculate or store the coordinates of the points $A_1$ and $B_1$ redundantly when the above-stated operations are subjected to actual implementation. This would be understood from the fact that the point $B_1$ is located at the midpoint between the point $A_1$ and the origin O as shown in FIG. 9. Although a description is given below of an embodiment in which the coordinates of the point $B_1$ is calculated, the calculation of the coordinates of the point $A_1$ is substantially equivalent to those of the point $B_1$.

Similar operations are performed in the second parallel displacement and midpoint calculation. First, the points $A_1$, $B_1$ and $C_1$ are subjected to such a parallel displacement that the point $B_1$ is shifted to the origin. The points $A_1$, $B_1$ and $C_1$ after the parallel displacement are denoted by $A_1'$, $B_1'$ and $C_1'$, respectively. Additionally, the parallel displacement distance $BX_1$ in the X-axis direction is subtracted from the target gray-level value thereby calculating the target gray-level value $X_IN_2$. Next, a first order midpoint $d_1'$ between the points $A_1'$ and $B_1'$ and a first order midpoint $e_1'$ between the points $B_1'$ and $C_1'$ are calculated, and further a second order midpoint $f_1'$ between the first order midpoints $d_1'$ and $e_1'$ is calculated.

Similarly to Equations (12) to (18), the following equations are obtained:

$$X_IN_2=X_IN_1-B_{X1}, \quad (21)$$

$$X_{f1}'=(AX_1-2BX_1+CX_1)/4, \text{ and} \quad (22)$$

(A) for $X_{f1}' \geq X_IN_2$, $$AX_2=AX_1-BX_1, \quad (23a)$$

$$BX_2=(AX_1-BX_1)/2, \quad (24a)$$

$$CX_2=X_{f1}'=(AX_1-2BX_1+CX_1)/4, \quad (25)$$

$$AY_2=AY_1-BY_1, \quad (26a)$$

$$BY_2=(AY_1-BY_1)/2, \text{ and} \quad (27a)$$

$$CY_2=Y_{f1}'=(AY_1-2BY_1+CY_1)/4, \quad (28)$$

(B) for $X_{f1}'<X_IN_2$, $$AX_2=CX_1-BX_1, \quad (23b)$$

$$BX_2=(CX_1-BX_1)/2, \quad (24b)$$

$$CX_2=(AY_1-2BY_1+CY_1)/4, \quad (25)$$

$$AY_2=CY_1-BY_1, \quad (26b)$$

$$BY_2=(CY_1-BY_1)/2, \text{ and} \quad (27b)$$

$$CY_2=(AY_1-2BY_1+CY_1)/4. \quad (28)$$

By substituting Equation (19) into Equations (24a) and (25) and Equation (20) into Equations (27a) and (28), the following Equations (29a) to (32) are obtained:

$$BX_2 = BX_1/2, \text{ (for } CX_1 \geq X_IN_2) \quad (29a)$$

$$= (CX_1 - BX_1)/2, \text{ (for } CX_1 < X_IN_2) \quad (29b)$$

$$CX_2 = CX_1/4, \quad (30)$$

$$BY_2 = BY_1/2, \text{ (for } CX_1 \geq X_IN_2) \quad (31a)$$

$$= (CY_1 - BY_1)/2, \text{ (for } CX_1 < X_IN_2) \text{ and} \quad (31b)$$

$$CY_2 = CY_1/4. \quad (32)$$

It should be noted that there is no need to calculate or store the X-coordinate value $AX_2$ and the Y-coordinate value $AY_2$ of the point $A_2$ redundantly, since the following relationship is established as is the case of Equations (19) and (20):

$$AX_2=2BX_2, \text{ and} \quad (33)$$

$$AY_2=2BY_2, \quad (34)$$

Similar operations are performed in the third and subsequent parallel displacement and midpoint calculations. Similarly to the second parallel displacement and midpoint calculation, it would be understood that the operations performed in the i-th parallel displacement and midpoint calculation (for i≥2) is expressed by the following Equations (35) to (39):

$$X_IN_i = X_IN_{i-1} - BX_{i-1}, \quad (35)$$

$$BX_i = BX_{i-1}/2, \text{ (for } CX_{i-1} \geq X_IN_i) \quad (36a)$$

$$= (CX_{i-1} - BX_{i-2})/2, \text{ (for } CX_{i-1} < X_IN_i) \quad (36b)$$

$$CX_i = CX_{i-1}/4, \quad (37)$$

$$BY_i = BY_{i-1}/2, \text{ (for } CX_{i-1} \geq X_IN_i) \quad (38a)$$

$$= (CY_{i-1} - BY_{i-1})/2, \text{ (for } CX_{i-1} < X_IN_i) \text{ and} \quad (38b)$$

$$CY_i = CY_{i-1}/4. \quad (39)$$

It would be obvious for the person skilled in the art that the equal sign may be attached to either the inequality sign described in Equation (36a) or that in Equation (36b).

Equations (37) and (39) implies that the point $C_1$ is positioned in the segment connecting the origin O to the point $C_{1-i}$ and that the distance of the point $C_i$ from the origin O is a quarter of the length of the segment $OC_{i-1}$. That is, the repetition of the parallel displacement and midpoint calculation makes the point $C_i$ closer to the origin O. It would be readily understood that such a relationship allows simplification of the calculation of coordinates of the point $C_1$. It should be also noted that there is no need to calculate or store the coordinates of the points $A_2$ to $A_N$ in the second and following parallel displacement and midpoint calculations similarly to the first parallel displacement and midpoint calculation, since Equations (35) to (39) do not include the coordinates of the points $A_i$ and $A_{i-1}$.

The output gray-level value Y_OUT to be finally obtained by repeating the parallel displacement and midpoint calculation N times is obtained as the Y-coordinate value of the point $B_N$ with all the parallel displacements cancelled (which is identical to the Y-coordinate value of the point $B_N$ shown in FIG. 4). That is, the output coordinate value Y_OUT can be calculated the following Equation (40):

$$Y_OUT=BY_O+BY_1+\ldots+BY_{i-1}. \quad (40)$$

Such an operation can be achieved by performing the following operation in the i-th translation/operation:

$$Y_OUT_1=BY_O, \text{ and (for i=1)}$$

$$Y_OUT_1=Y_OUT_{i-1}+BY_{i-1}. \text{ (for } i\geq 2) \quad (41)$$

In this case, the output gray-level value Y_OUT of interest is obtained as $Y_OUT_N$.

Figure 10:
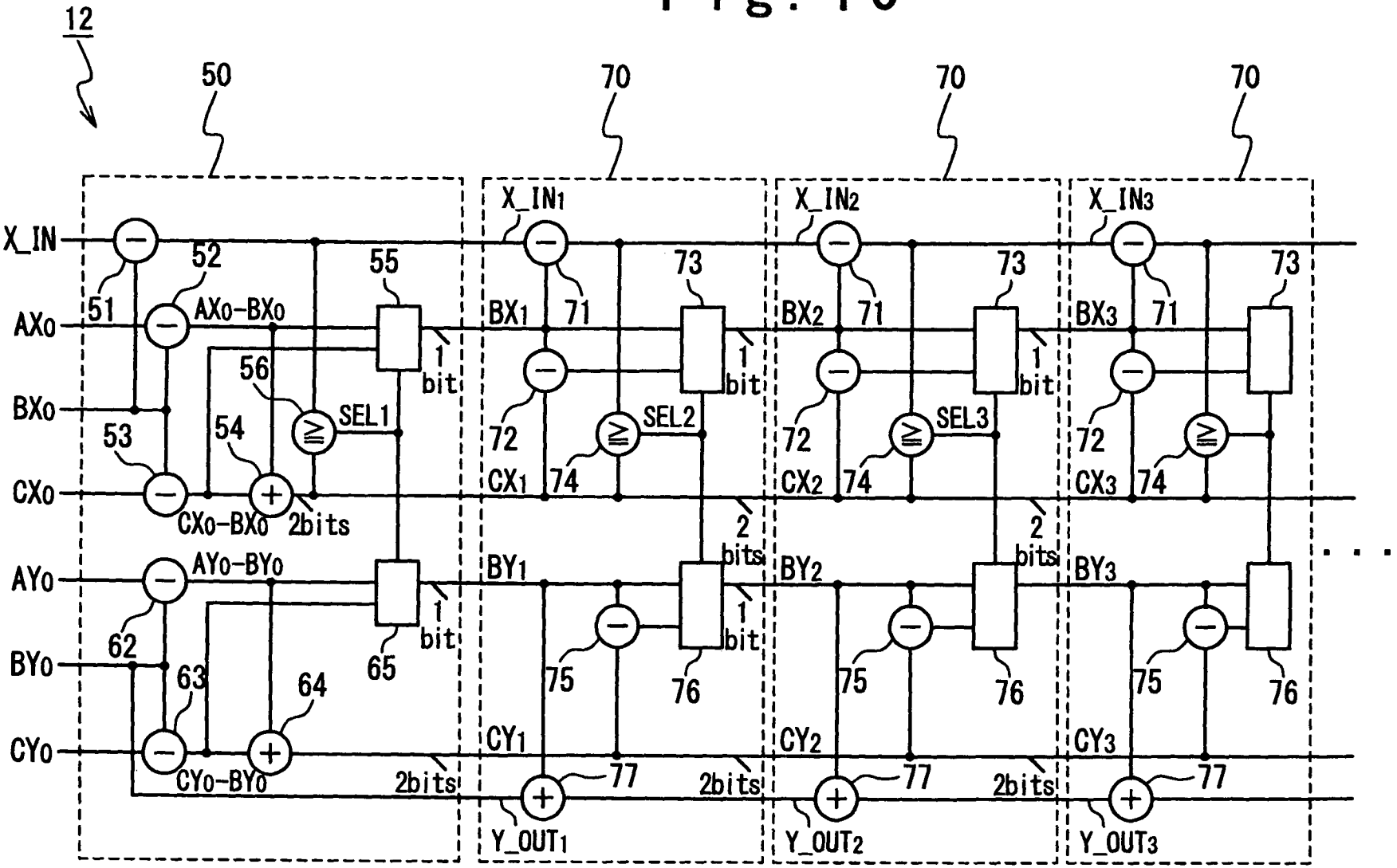
FIG. 10 is a circuit diagram showing a V-T arithmetic processing circuit implementing the algorithm shown in FIG. 9.

FIG. 10 is a circuit diagram showing an exemplary configuration of the V-T arithmetic operation circuit 12 in which the parallel displacement and midpoint calculation stated above is implemented with hardware. The V-T arithmetic operation circuit 12 shown in FIG. 10 includes an initial operation stage 50 and a plurality of unit operation stages 70 connected in series to the output of the initial operation stage 50. The initial operation stage 50 has a function of achieving the first parallel displacement and midpoint calculation and is configured to perform the operations expressed by Equations (12) to (18). The unit operation stages 70 have a function of achieving the second and following parallel displacement and midpoint calculations and are configured to perform the operations expressed by Equations (33) to (36) and (38).

More specifically, the initial operation stage 50 includes subtractors 51 to 53, an adder 54, a selector 55, a comparator 56, subtractors 62 and 63, an adder 64, and a selector 65. The initial operation unit 50 includes seven input terminals; the input gray-level value X_IN is inputted to one of the input terminals, and X-coordinate values $AX_O$, $BX_O$, and $CX_O$ and Y-coordinate values $AY_O$, $BY_O$, and $CY_O$ of the points $A_O$, $B_O$, and $C_O$ are supplied to the other six terminals thereof, respectively.

The subtracter 51 has a first input connected to the input terminal of the initial-operation unit 50 to which the input gray-level value X_IN is supplied and a second input connected to the input terminal thereof to which the X-coordinate value $BX_O$ is supplied. The subtracter 52 has a first input connected to the input terminal of the initial-operation unit 50 to which the X-coordinate value $AX_O$ is supplied and a second input connected to the input terminal thereof to which the X-coordinate value $BX_O$ is supplied: The subtracter 53 has a first input connected to the input terminal, of the initial-operation unit 50 to which the X-coordinate value $CX_O$ is supplied and a second input connected to the input terminal thereof to which the X-coordinate value $BX_O$ is supplied. The adder 54 has a first input connected to the output of the subtracter 52 and a second input connected to the output of the subtracter 53.

Correspondingly, the subtracter 62 has a first input connected to the input terminal of the initial-operation unit 50 to which the Y-coordinate value $AY_O$ is supplied and a second input connected to the input terminal thereof to which the Y-coordinate value $BY_O$ is supplied. The subtracter 63 has a first input connected to the input terminal of the initial-operation unit 50 to which the Y-coordinate value $CY_O$ is supplied and a second input connected to the input terminal thereof to which the Y-coordinate value $BY_O$ is supplied. The adder 64 has a first input connected to the output of the subtracter 62 and a second input connected to the output of the subtracter 63.

The comparator 56 has a first input connected to the output of the subtracter 51 and a second input connected to the output of the adder 54. The selector 55 has a first input connected to the output of the subtracter 52 and a second input connected to the output of the subtracter 53, and selects the first or second input in response to the output value SEL1 from the comparator 56. Furthermore, the selector 65 has a first input connected to the subtracter 62 and a second input connected to the output of the subtracter 63, and selects the first or second input in response to the output value SEL1 from the comparator 56.

The output terminal of the initial operation stage 50 from which the target gray-level value $X_IN_1$ is outputted is connected to the output of the subtracter 51. Further, the output terminal of the initial operation stage 50 from which the X-coordinate value $BX_1$ is outputted is connected to the output of the selector 55, and the output terminal thereof from which the X-coordinate value $CX_1$ is outputted is connected to the output of the adder 54. Furthermore, the output terminal of the initial operation stage 50 from which the Y-coordinate value $BY_1$ is outputted is connected to the output of the selector 65, and the output terminal thereof from which the Y-coordinate value $CY_1$ is outputted is connected to the output of the adder 64.

The subtracter 51 performs the operation expressed by Equation (12), and the subtracter 52 performs the operation expressed by Equation (14a). The subtracter 53 performs the operation expressed by Equation (14b), and the adder 54 performs the operation expressed by Equations (13) and (15) on the basis of the output values of the subtractors 52 and 53. Correspondingly, the subtracter 62 performs the operation expressed by Equation (17a). The subtracter 63 performs the operation expressed by Equation (17b), and the adder 64 performs the operation expressed by Equation (18) on the basis of the output values of the subtractors 62 and 63. The comparator 56 compares the output value of the subtracter 51 (that is, $X_IN_O-BX_O$) with the output value of the adder 54, and instructs the selectors 55 and 56 to select which of the two output values thereof is to be outputted as the output value. When $X_IN_O-BX_O$ is equal to or smaller than $(AX_O-2BX_O+CX_O)/4$, then the selector 55 selects the output value of the subtracter 52 and the selector 65 selects the output value of the subtracter 62. If $X_IN_O-BX_O$ is larger than $(AX_O-2BX_O+CX_O)/4$, then the selector 55 selects the output value of the subtracter 53 and the selector 65 selects the output value of the subtracter 63. The values selected by the selectors 55 and 65 are supplied to the next unit operation stage 70 as $BX_1$ and $BY_1$, respectively.

Furthermore, the output values from the adders 54 and 64 are supplied to the next unit operation stage 70 as $CX_1$ and $CY_1$, respectively.

It should be noted here that divisions included in Equations (12) to (18) can be realized by rounding down lower bits. The positions where the lower bits are rounded down in the circuit may be appropriately changed as long as operations equivalent to Equations (12) to (18) are performed. The initial operation stage 50 shown in FIG. 10 is configured to round down the lowest one bit on the outputs from the selectors 55 and 65 and to round down the lowest two bits on the outputs from the adders 54 and 64.

Meanwhile, each unit operation stage 70, which performs the second and subsequent parallel displacement and midpoint calculations, includes subtractors 71 and 72, a selector 73, a comparator 74, a subtracter 75, a selector 75, and an adder 77. Although a description is given below of the unit operation stage 70 which performs the second parallel displacement and midpoint calculation, it would be obvious for the person skilled in the art that the other unit operation stages 70 are configured similarly. The subtracter 71 has a first input connected to the input terminal of the unit operation stage 70 to which the target gray-level value $X_IN_1$ is supplied, and a second input connected to the input terminal thereof to which the X-coordinate value $BX_1$ is supplied. The subtracter 72 has a first input connected to the input terminal of the unit operation stage 70 to which the X-coordinate value $BX_1$ is supplied, and a second input connected to the input terminal thereof to which the X-coordinate value $CX_1$ is supplied. The subtracter 75 has a first input connected to the input terminal of the unit operation stage 70 to which the Y-coordinate value $BY_1$ is supplied, and a second input connected to the input terminal thereof to which the Y-coordinate value $CY_1$ is supplied.

The comparator 74 has a first input connected to an output of the subtracter 71 and a second input connected to the input of the unit operation stage 70 to which the X-coordinate value $CX_1$ is supplied.

The selector 73 has a first input connected to the input terminal of the unit operation stage 70 to which the X-coordinate value $BX_1$ is supplied, and a second input connected to an output of the subtracter 72, and selects the first or second input in response to the output value $SEL_i$ of the comparator 74. Similarly, the selector 76 has a first input connected to the input terminal of the unit operation stage 70 to which the Y-coordinate value $BY_1$ is supplied, and a second input connected to an output of the subtracter 75, and selects the first or second input in response to the output value of the comparator 74.

The target gray-level value $X_IN_2$ is outputted from the output terminal of the unit operation stage 70 connected to the output of the subtracter 71. The X-coordinate value $BX_i$ is outputted from the output terminal of the unit operation stage 70 connected to the output of the selector 73, and the X-coordinate value $CX_i$ is outputted from an output terminal thereof connected to the input terminal thereof to which the X-coordinate value $CX_{i-1}$ is supplied via an interconnection. Here, the lower two bits of the X-coordinate value $CX_{i-1}$ are rounded down. Furthermore, the Y-coordinate value $BY_i$ is outputted from the output terminal of the unit operation stage 70 connected to the output of the selector 73, and the Y-coordinate value $CY_i$ is outputted from the output terminal thereof connected to the input terminal thereof to which the Y-coordinate value $CY_{i-1}$ is supplied via an interconnection. Here, the lower two bits of the Y-coordinate value $CY_{i-1}$ are rounded down.

Moreover, the adder 77 has a first input connected to the input terminal of the unit operation stage 70 to which the X-coordinate value $BX_1$ is supplied, and a second input connected to the input terminal thereof to which the output gray-level value $Y_OUT_1$ is supplied. It should be noted that the output gray-level value $Y_OUT_1$ coincides with the Y-coordinate value $BY_O$. The output gray-level value $Y_OUT_2$ is outputted from an output of the adder 77.

The subtracter 71 performs the operation expressed by Equation (35), and the subtracter 72 performs the operation expressed by Equation (36b). The subtracter 75 performs the operation expressed by Equation (38b), and the adder 77 performs the operation expressed by Equation (41). The comparator 74 compares the output value $X_IN_i$ (=$X_IN_{i-1}-BX_{i-1}$) of the subtracter 71 with the X-coordinate value $CX_{i-1}$, and instructs the selectors 73 and 76 to select which of the two output values thereof is to be outputted as the output value. When $X_IN_i$ is equal to or smaller than $CX_{i-1}$, then the selector 73 selects $BX_{i-1}$ and the selector 76 selects $BY_{i-1}$. When $X_IN_i$ is larger than $CX_{i-1}$, on the other hand, the selector 73 selects the output value from the subtracter 72 and the selector 76 selects the output value from the subtracter 75. The values selected by the selectors 73 and 76 are supplied to the next unit operation stage 70 as $BX_i$ and $BY_i$, respectively. Furthermore, the values obtained by rounding down the lower two bits of $CX_{i-1}$ and $CY_{i-1}$ are supplied to the next unit operation stage 70 as $CX_i$ and $CY_i$, respectively.

It should be noted here that divisions included in Equations (36) to (39) can be realized by rounding down lower bits. The positions where the lower bits are rounded down in the circuit may be appropriately changed as long as operations equivalent to Equations (36) to (39) are performed. The unit operation operation unit 70 shown in FIG. 10 is configured to round down the lower one bit on the outputs of the selectors 73 and 76 and to round down the lower two bits on the wirings receiving $CX_{i-1}$ and $CY_{i-1}$.

It would be understood from the comparison of the unit operation stage 70 shown in FIG. 10 with the unit operation stage 30 shown in FIG. 6 that the above-described optimization of the operation advantageously the number of operation units. Besides, in the configuration for performing the parallel displacement and midpoint calculation as shown in FIG. 10, in which each operation unit is configured to round down lower bits, the number of bits of data dealt with by a unit operation stage 70 is smaller than that by the former unit operation stage(s) 70. As thus discussed, the configuration for performing the parallel displacement and midpoint calculation as shown in FIG. 10 allows calculating the output gray-level value Y_OUT with reduced hardware utilization.

Also in a case where the gamma curve is expressed by an (N−1)th-order Bezier curve, midpoint calculation can be performed after performing parallel displacement on the control points so that one of the control points after the parallel displacement is shifted to the origin O similarly to the instance of the quadric Bezier curve. In a case where the gamma curve is expressed by a cubic Bezier curve, for example, the first to (N−1)-th order midpoints are calculated after subjecting the control points to parallel displacement so that the control point $B_{i-1}$ or $C_{i-1}$ is shifted to the origin O. Further, either a combination of the control point $A_{i-1}'$ obtained by the parallel displacement, the first order minimum midpoint, the second order minimum midpoint, and the third order midpoint or a combination of the third order midpoint, the second order maximum midpoint, the first order maximum midpoint, and the control point $D_{i-1}'$ are selected as the next control points $A_i$, $B_i$, $C_i$ and $D_i$. This also allows decreasing the number of bits of values processed by each operation unit, similarly to the case of the quadric Bezier curve.

Figure 11A:
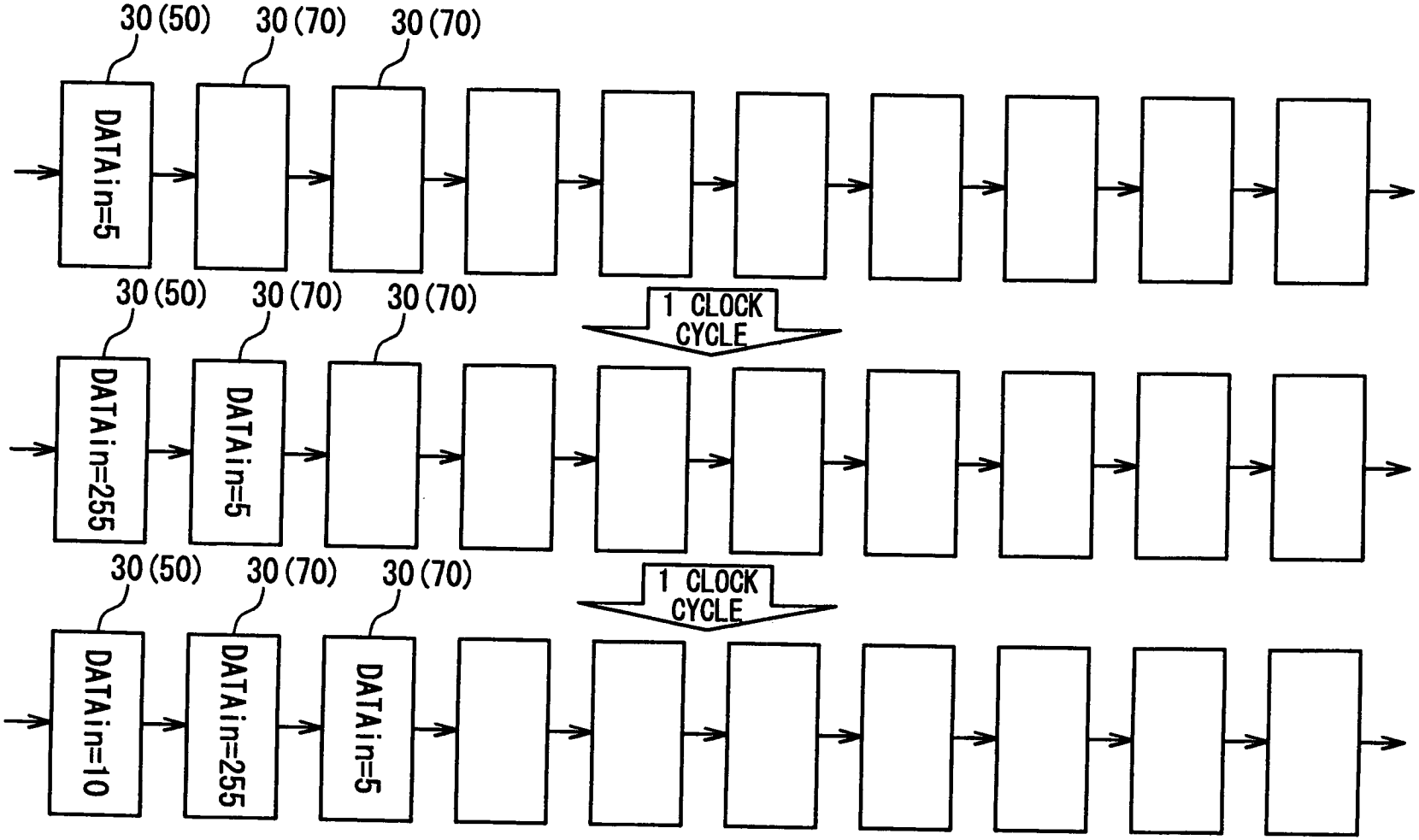
FIG. 11A is a conceptual diagram showing a pipeline processing in gamma correction operation in still another embodiment of the present invention.

Referring to FIG. 11A, the V-T arithmetic processing circuit 12 may be configured to perform pipeline processing for any the circuit configurations shown in FIGS. 5, 8 and 10. In a first clock cycle, the initial unit operation stage 30, 120 or the initial operation stage 50 performs the first midpoint calculation or the first parallel displacement and midpoint calculation for a first pixel. In a second clock cycle, the second unit operation stage 30, 120 or 70 performs the second midpoint calculation or the second parallel displacement and midpoint calculation for the first pixel, and the initial-stage unit operation stage 30, 120 or the initial operation stage 50 performs the first midpoint calculation or the first parallel displacement and midpoint calculation for a second pixel. In third and subsequent clock cycles, the midpoint calculations or the parallel displacement and midpoint calculations are similarly performed.

Figure 11B:
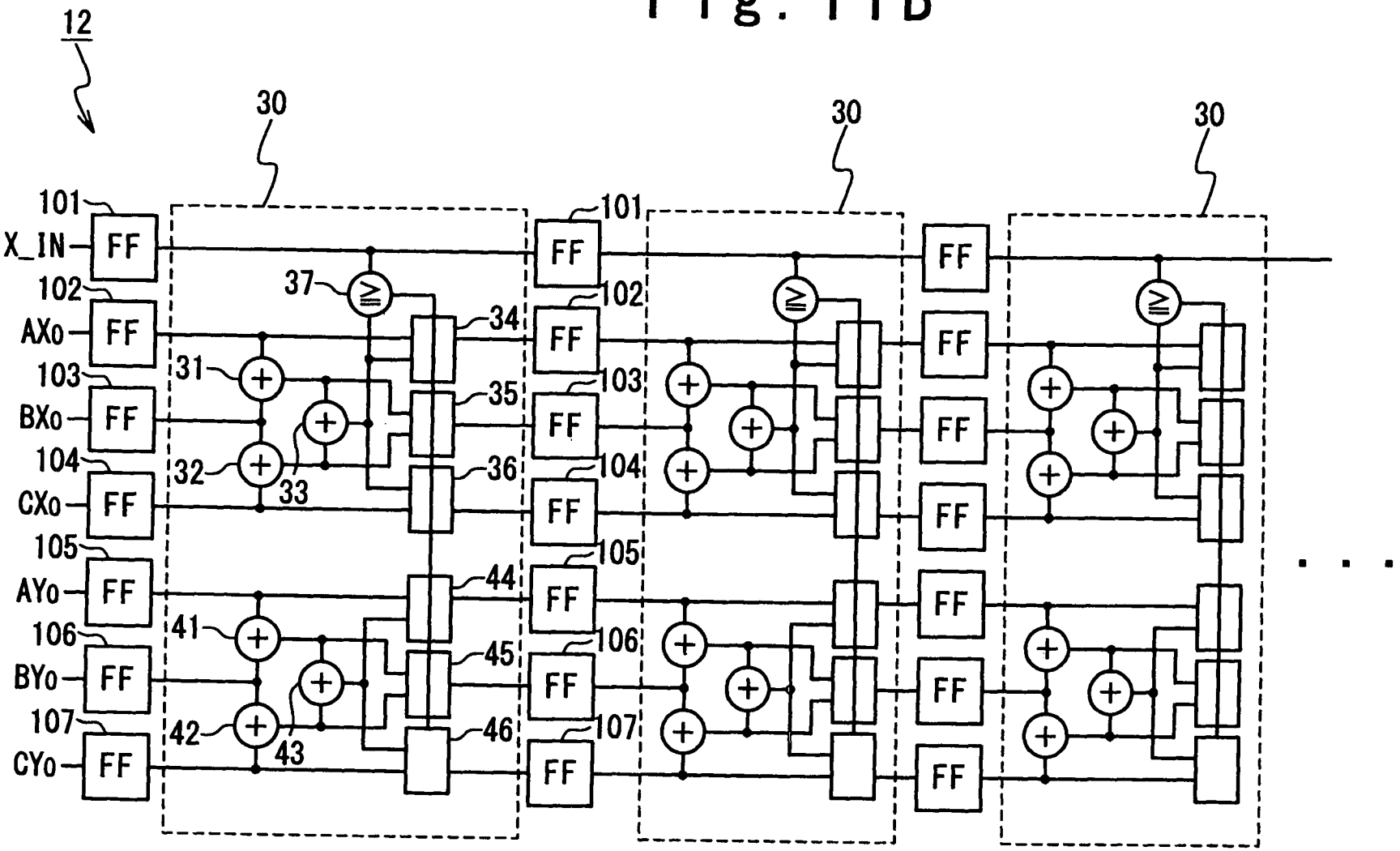
FIG. 11B is a circuit diagram showing an exemplary configuration of a V-T arithmetic processing circuit configured to perform the pipeline processing.
Figure 11C:
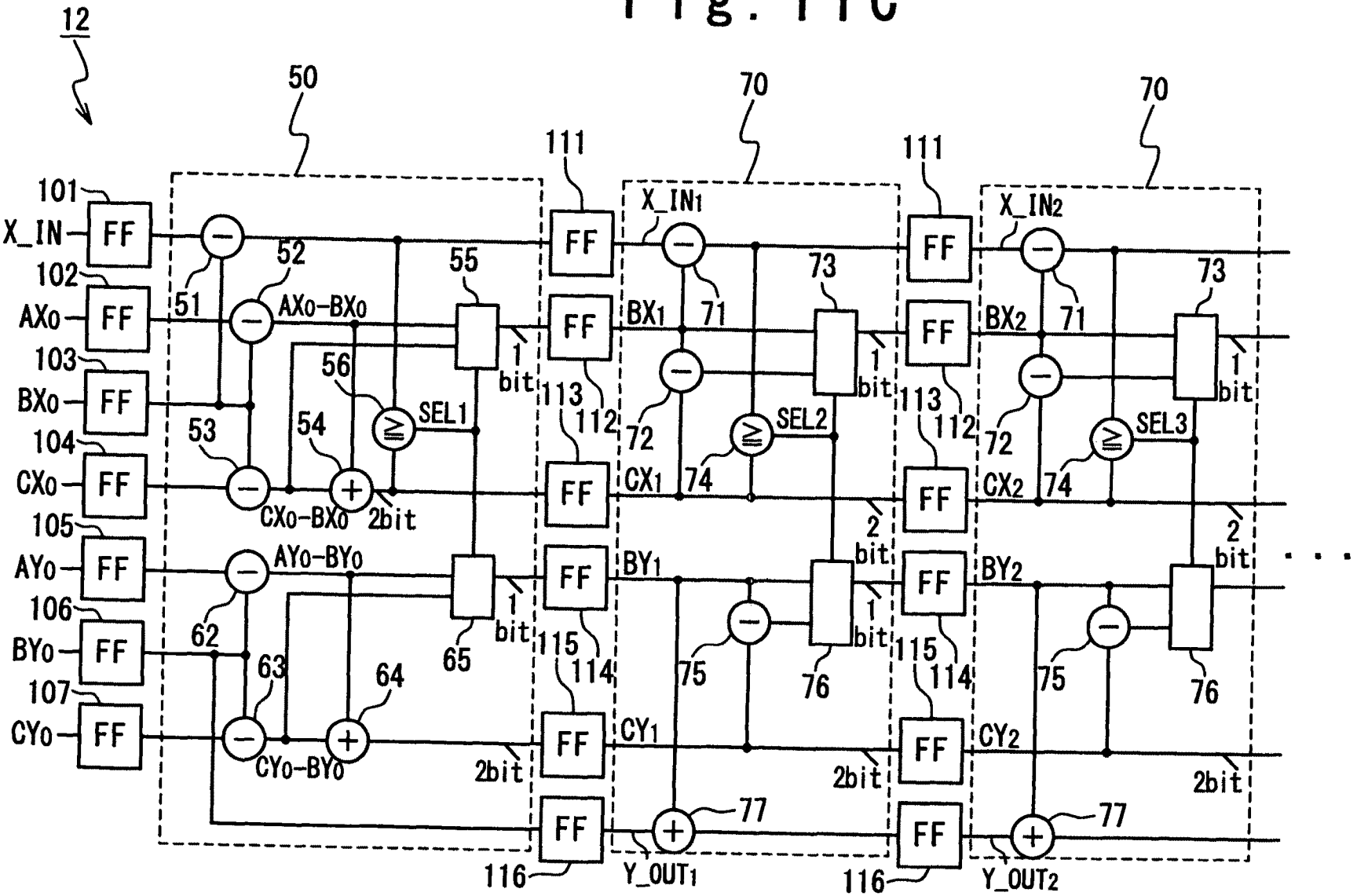
FIG. 11C is a circuit diagram showing another exemplary configuration of a V-T arithmetic processing circuit configured to perform the pipeline processing.

When the V-T arithmetic processing circuit 12 performs the pipeline processing, flip-flops are connected to the input terminals of the respective unit operation stages 30, 120, initial operation stage 50 and unit operation stages 70. Specifically, as for the unit operation stage 30, flip-flops 101 to 107 are provided on the input terminals of each unit operation stage 30 to which X_IN, $AX_{i-1}$, $BX_{i-1}$, $CX_{i-1}$, $AY_{i-1}$, $BY_{i-1}$, and $CY_{i-1}$ are supplied, respectively, as shown in FIG. 11B. Furthermore, as for the initial operation stage 50, as shown in FIG. 11C, flip-flops 101 to 107 are provided on the input terminals of the initial operation stage 50 to which X_IN, $AX_O$, $BX_O$, $CX_O$, $AY_O$, $BY_O$ and $CY_O$ are supplied, respectively, similarly to the unit operation stage 30. In addition, as for the unit operation stages 70, flip-flops 111 to 116 are provided on the input terminals of the unit operation stages 70 to which $X_IN_{i-1}$, $BX_{i-1}$, $CX_{i-1}$, $BY_{i-1}$, $CY_{i-1}$ and $Y_OUT_{i-1}$ are supplied, respectively. The same goes for the unit operation stage 120 shown in FIG. 10.

In this case, the V-T arithmetic processing circuit 12 may be configured to perform a plurality of midpoint calculations or a plurality of parallel displacement and midpoint calculations in one clock cycle. To perform N midpoint calculations in one clock cycle, a set of flip-flops 101 to 107 are provided at intervals of N unit operation stages 30. In this case, the unnecessary flip-flops 101 to 108 are eliminated from the circuit configuration shown in FIG. 11B. Similarly, to perform N parallel displacement and midpoint calculations in one clock cycle, a set of flip-flops 101 to 107 or 111 to 116 are provided at intervals of a plurality of operation units (initial operation stage 50 and unit operation stages 70). In this case, the unnecessary flip-flops 111 to 116 are eliminated from the circuit configuration shown in FIG. 11C.

Figure 12:
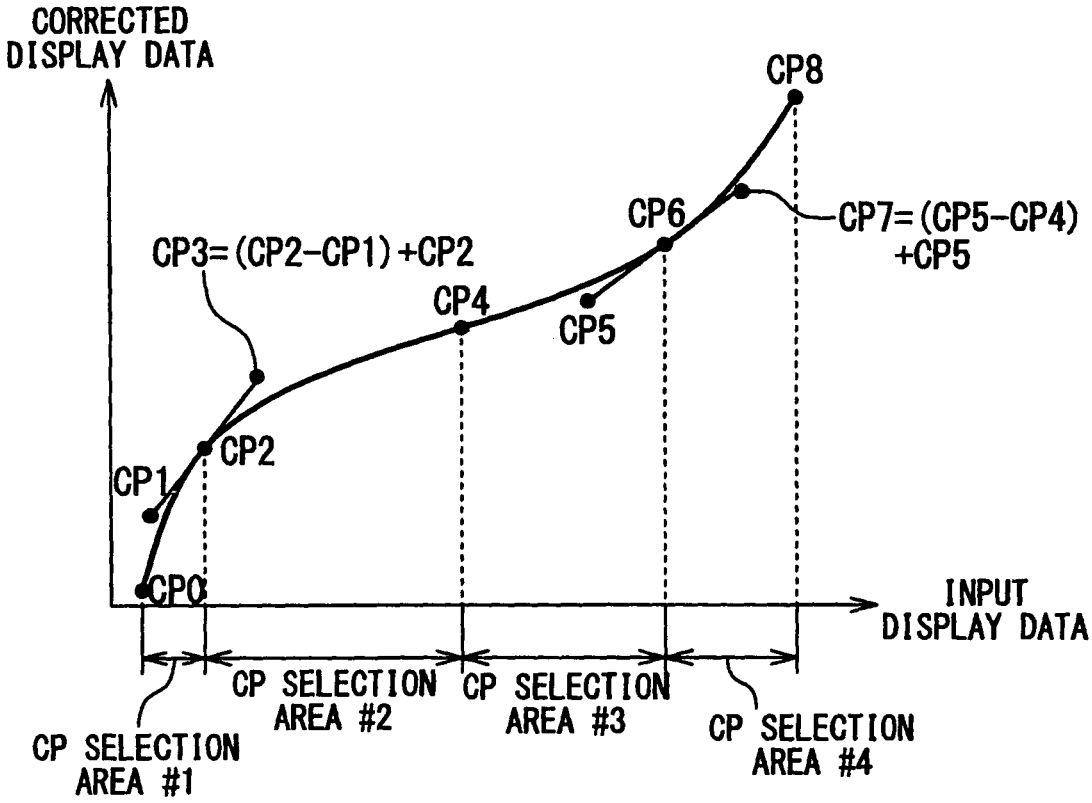
FIG. 12 is a circuit diagram showing a technique for decreasing the number of control points set in a control circuit.

Referring to FIG. 12, it should be noted that all of the control, points CP0 to CP8 are not necessarily stored in the control circuit 11. The number of coordinates of control points stored in the control circuit 11 may be decreased by calculating the coordinates of a certain control point from those of one or more other control points. This effectively reduces the circuit scale of the control circuit. The number of coordinates of the control points stored in the control circuit 11 can be decreased by, for example, calculating the coordinates of the control points CP3 and CP7 with the following Equations (42a) to (42d), respectively:

$$CPX_3=(CPX_2-CPX_1)+CPX_2, \tag{42a}$$

$$CPY_3=(CPY_2-CPY_1)+CPY_2, \tag{42b}$$

$$CPX_7=(CPX_6-CPX_5)+CPX_6, \text{ and} \tag{42c}$$

$$CPY_7=(CPY_6-CPY_5)+CPY_6. \tag{42d}$$

Such operation may be performed in the control circuit 11 or in the V-T arithmetic processing circuit 12.

Figure 13A:
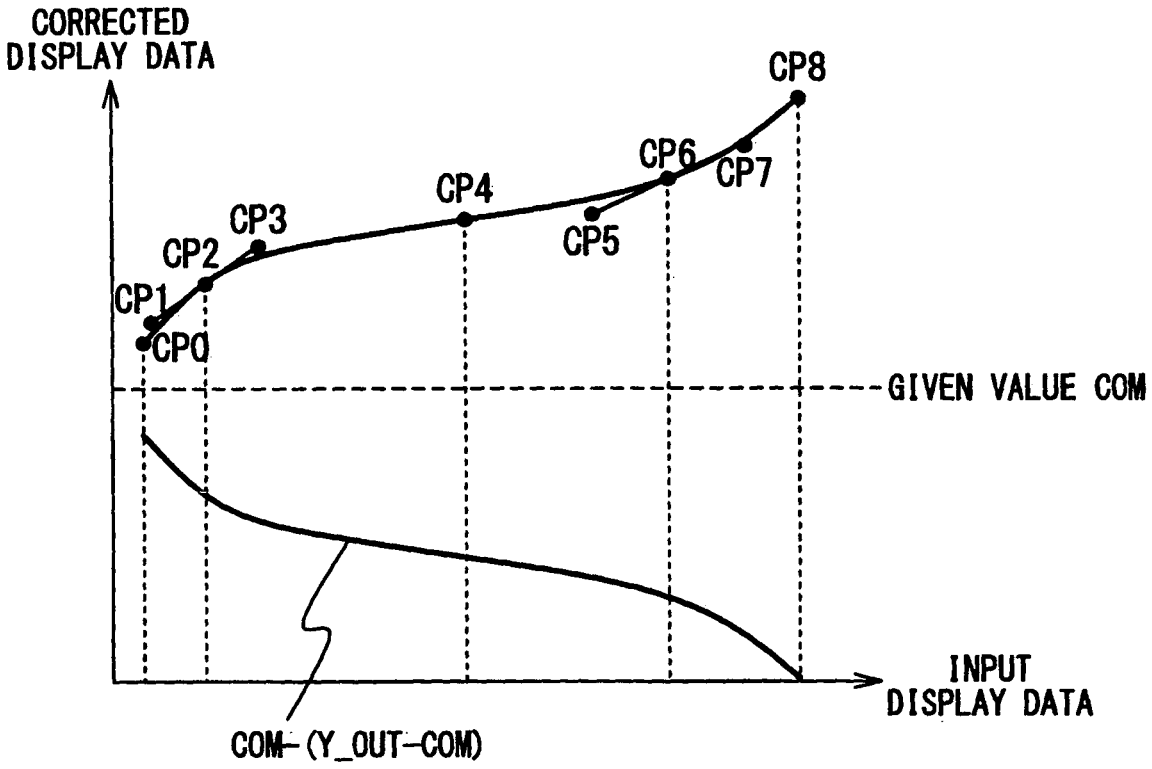
FIG. 13A is a conceptual diagram showing a technique for allowing one V-T arithmetic processing circuit to perform gamma correction operations for generating both of the gray-level voltages having positive and negative polarities.

Referring to FIG. 13A, when pixels are driven with the potential level of the counter electrode fixed (common fixed driving), it is necessary to generate two gray-level voltages for the same gray-level value (gray-level voltages of the positive and negative polarities with respect to the voltage level of the counter electrode (common level $V_{COM}$)). In this case, it is necessary to configure the V-T arithmetic processing circuit 12 to be able to calculate gray-level values of two different corrected display data 22 for the same gray-level value of the input display data 5 according to the polarity of the actually outputted gray-level voltage. In one embodiment, two V-T arithmetic processing circuits 12 may be prepared for performing gamma correction operations in accordance with different gamma characteristics, respectively. It is, however, undesirable to prepare two V-T arithmetic processing circuits 12 in view of the circuit scale.

In order to reduce the circuit scale, the V-T arithmetic processing circuit 12 may be configured to perform the gamma correction operation for generating gray-level voltages of the positive polarity, and the gamma correction operation for generating gray-level voltages of the negative polarity may be realized by performing the following operation on the output gray-level value $Y_OUT^+$ outputted from the V-T arithmetic processing circuit 12:

$$\begin{aligned} Y_OUT^- &= COM - (Y_OUT^+ - COM), \\ &= 2COM - Y_OUT^+, \end{aligned} \tag{43a}$$

where $Y_OUT^-$ is the corresponding gamma-corrected gray-level value for the gray-level voltage of the negative polarity.

Figure 13B:
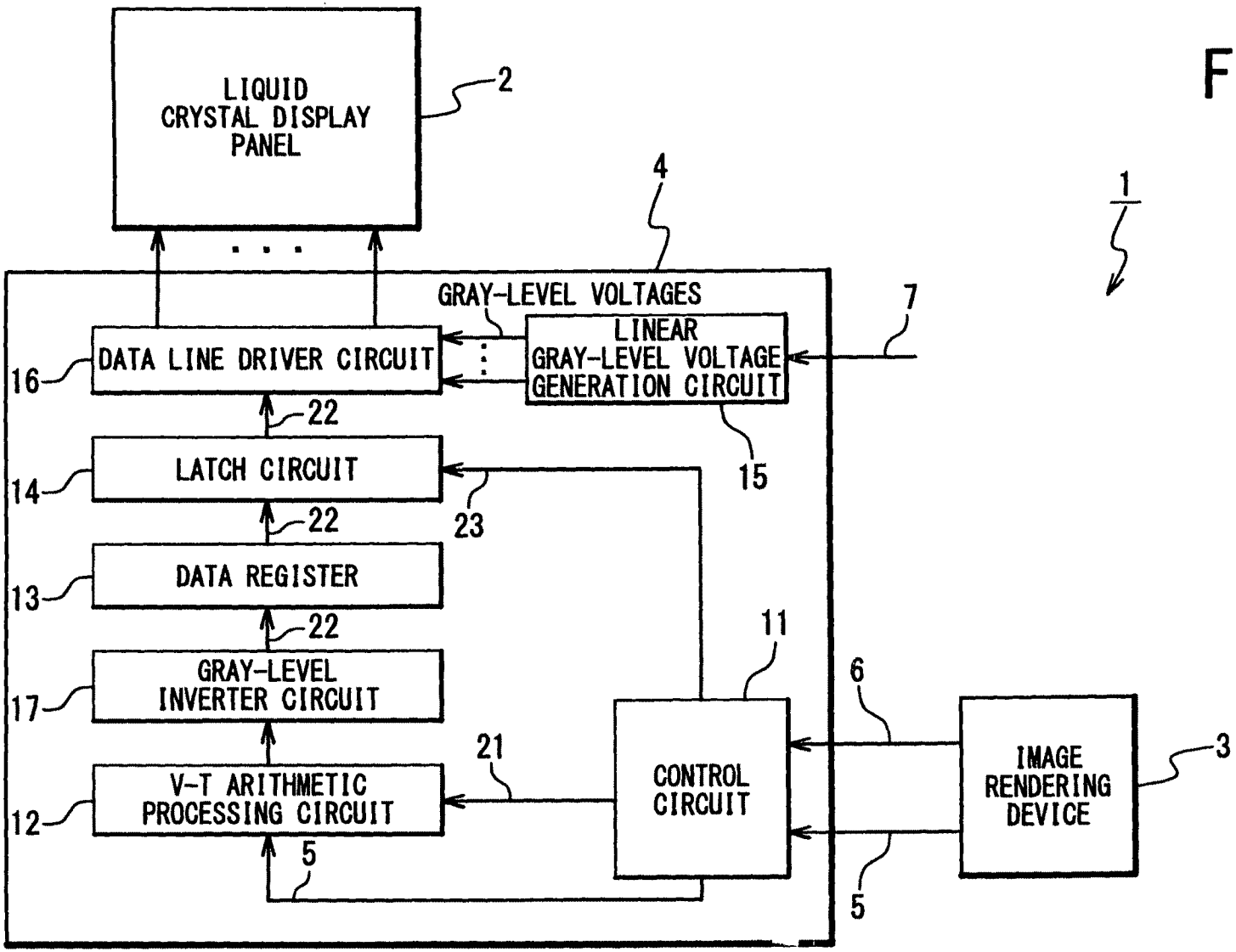
FIG. 13B is a block diagram showing a configuration of a control driver for allowing one V-T arithmetic processing circuit to perform the gamma correction operations for generating the gray-level voltages having the positive and negative polarities.

FIG. 13B is a diagram showing an exemplary configuration of the controller driver 4 configured to perform such operation. With the configuration of FIG. 13B, a gray-level inverter circuit 17 is inserted between the V-T arithmetic processing circuit 12 and the data register 13.

The gray-level inverter circuit 17 outputs the output gray-level value $Y_OUT^+$ outputted from the V-T arithmetic processing circuit 12 as the corrected display data 22 as it is for a pixel to be driven with a gray-level voltage of the positive polarity. The gray-level inverter circuit 17 performs the operation expressed by Equation (43a) on the output gray-level value $Y_OUT^+$ outputted from the V-T arithmetic processing circuit 12, and outputs the resultant value as the corrected display data 22 for a pixel to be driven with a gray-level voltage of the negative polarity.

Alternatively, the V-T arithmetic processing circuit 12 may be configured to perform the gamma correction operation for generating gray-level voltages of the negative polarity, and the gamma correction operation for generating the gray-level voltage of the positive polarity may be realized by performing the following operation on the output gray-level value $Y_OUT^-$ outputted from the V-T arithmetic processing circuit 12:

$$\begin{aligned} Y_OUT^+ &= COM - (COM - Y_OUT^-), \\ &= 2COM - Y_OUT^-. \end{aligned} \tag{43b}$$

In this case, the gray-level inverter circuit 17 outputs the output gray-level value $Y_OUT^-$ outputted from the V-T arithmetic processing circuit 12 as the corrected display data 22 as it is for a pixel to be driven with a gray-level voltage of the negative polarity. On the other hand, the gray-level inverter circuit 17 performs the operation expressed by Equation (43b) on the output gray-level value $Y_OUT^-$ outputted from the V-T arithmetic processing circuit 12, and outputs the resultant value as the corrected display data 22 for a pixel to be driven with a gray-level voltage of the positive polarity.

Figure 14:
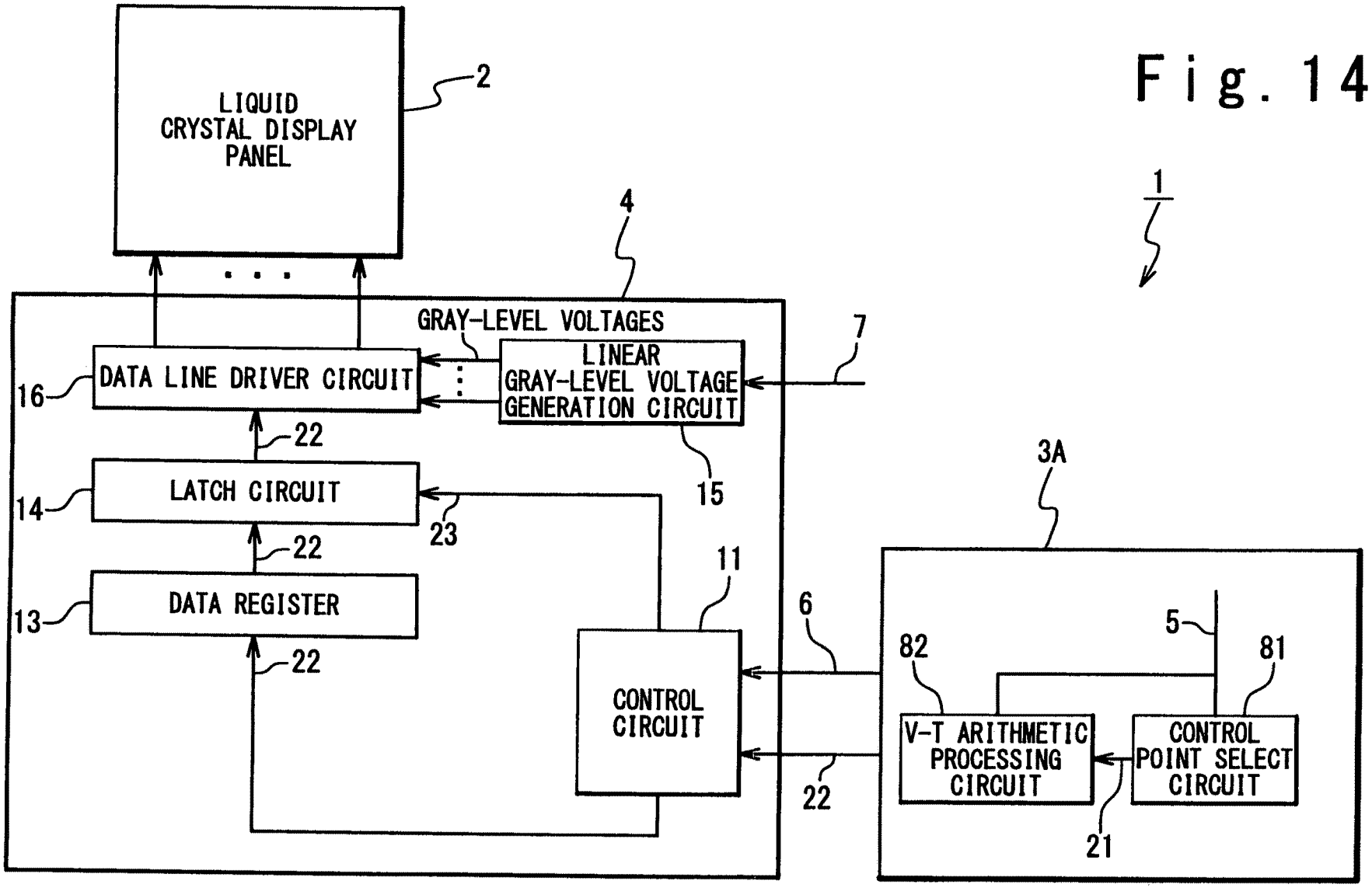
FIG. 14 is a block diagram showing an exemplary configuration of a display device in still another embodiment of the present invention.
Figure 15:
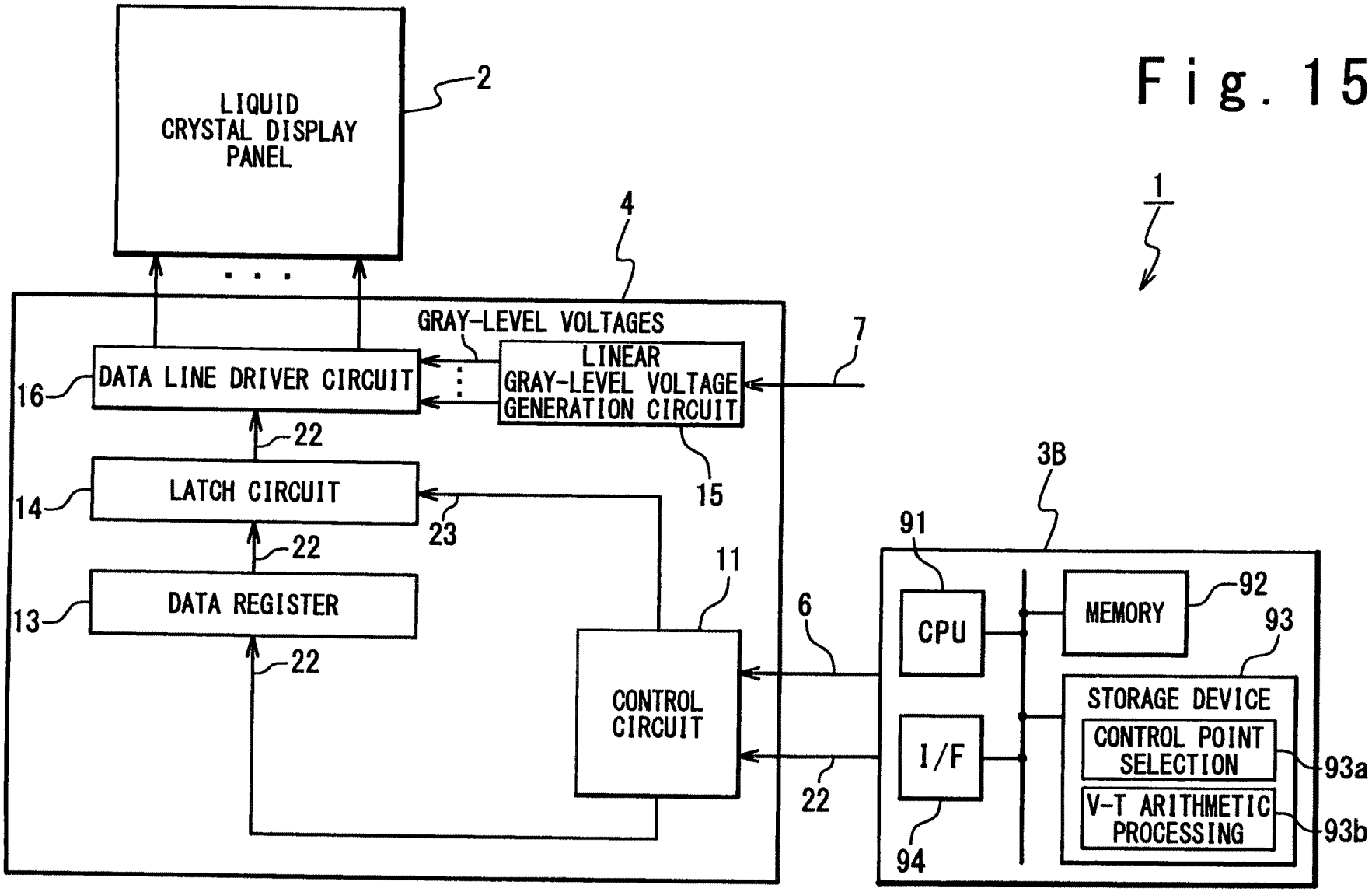
FIG. 15 is a block diagram showing an exemplary configuration of a display device in still another embodiment of the present invention.

Although the controller driver 4 are described as perform the gamma correction operation in the above-described embodiments, the liquid crystal display device 1 may be instead configured to supply the corrected display data 22 obtained by the gamma correction operation to the controller driver 4 as shown in FIGS. 14 and 15. In the configuration shown in FIG. 14, the image rendering device 3A includes a control point selector circuit 81 and a V-T arithmetic processing circuit 82. The control point selector circuit 81 generates control point data 21 from the input display data 5, and the V-T arithmetic processing circuit 82 performs the above-stated gamma correction operation on the input display data 5 in accordance with the control point data 21 to generate the corrected display data 22. The generated corrected display data 22 are transmitted to the controller driver 4 and used to drive the data lines of the liquid crystal display panel 2.

On the other hand, FIG. 15 is a block diagram showing an exemplary configuration of the liquid crystal display device 1 in which the corrected display data 22 are generated from the input display data 5 by means of software. A processor 3B includes a CPU 91, a memory 92, a storage device 93, and an I/F 94. A control point selection module 93*a* and a V-T arithmetic processing module 93*b* are prepared in the storage device 93. The control point selection module 93*a* is a software program for generating the control point data 21 from the input display data 5. The V-T arithmetic processing module 93*b* is a software program for performing the above-stated gamma correction operation on the input display data 5 in accordance with the control point data 21 to generate the corrected display data 22. The CPU 91 executes codes described in the control point selection module 93*a* and the V-T arithmetic processing module 93*b* to thereby generate the corrected display data 22. The generated corrected display data 22 are transmitted to the controller driver 4 by the I/F 94 and used to drive the data lines of the liquid crystal display panel 2. The control point selection module 93*a* and the V-T arithmetic processing module 93*b* may be installed onto the processor 3B by using a computer readable recording medium which records the control point selection module 93*a* and the V-T arithmetic processing module 93*b*. The technique of the embodiments described above also achieves reduction in the hardware utilization and improvement in accuracy in the gamma correction operation, even when the gamma correction operation is performed with software.

It would be apparent that the present invention is not limited to the above embodiments, but may be modified and changed without departing from the scope of the invention. It should be especially noted that, although the liquid crystal display device 1 is described as being configured to perform the gamma correction operation in the above-stated embodiments, the present invention is also applicable to general correction operations performed on the input display data whatever purposes. For example, the present invention is also applicable to correction operation for contrast enhancement.

Although the present invention is applied to the liquid crystal display device 1 in the above-described embodiment, it would be apparent to the person skilled in the art that the present invention is generally applicable to a display device in which display data are subjected to correction (for example, a display data using a plasma display panel, an organic light emitting diode display panel or other display panels).

What is claimed is:

1. A display data correction apparatus, comprising:

a select circuit responsive to an input gray-level value for initially selecting a first control point to an N-th control point (N≥3) defined in a coordinate system in which a first coordinate axis is associated with said input gray-level value and a second coordinate axis is associated with an output gray-level value to be calculated for said input gray-level value; and a processing circuit obtaining the output gray-level value by repeating an update operation in which said first control point to said N-th control point are updated to correct display data for a display device, wherein, in said update operation, a first operation and a second operation are selectively performed in response to a result of a comparison of a coordinate value of an (N−1)-th order midpoint along said first coordinate axis with said input gray-level value, wherein said first operation involves determining coordinate values of said first control point to said N-th control point after said update operation in response to coordinate values of a minimum control point, a first order minimum midpoint to an (N−2)-th order minimum midpoint and said (N−1)-th order midpoint before said update operation, wherein said second operation involves determining the coordinate values of said first control point to said N-th control point after said update operation in response to coordinate values of a maximum control point before said update operation, a first order maximum midpoint to an (N−2)-th order maximum midpoint and said (N−1)-th order midpoint before the update operation, wherein the update operation is repeatedly performed in an operation range having gray-level values according to the input gray-level value while narrowing the operation range, and the output gray-level value is calculated for said input gray-level value, wherein said first order maximum and minimum midpoints are each defined as a midpoint between two adjacent control points of said first control point to the N-th control point, a number of said first order maximum and minimum midpoints being N−1, the two adjacent control points of said first control point to the N-th control point comprising a control point of said first control point to said N-th control point and another control point of said first control point to said N-th control point being closest in distance with the control point of said first control point to said N-th control point, wherein (k+1)-th order midpoints are each defined as a midpoint between two adjacent k-th order midpoints of k-th order midpoints fork satisfying 1≤k≤N−2, a number of said (k+1)-th order midpoints being N−k−1, the two adjacent k-th order midpoints of said k-th order midpoints comprising a k-th order midpoint of said k-th order midpoints and another k-th order midpoint of said k-th order midpoints being closest in distance with the k-th order midpoint of said k-th order midpoints, wherein said minimum control point is defined as a control point which has a smallest coordinate value along said first coordinate axis among said first control point to said N-th control point, wherein said maximum control point is defined as a control point which has a largest coordinate value along said first coordinate axis among said first control point to said N-th control point;

wherein a k-th order minimum midpoint is defined as having a smallest coordinate value along said first coordinate axis among said k-th order midpoints, and wherein a k-th order maximum midpoint is defined as having a largest coordinate value along said first coordinate axis among said k-th order midpoints.

2. The display data correction apparatus, according to claim 1, wherein said update operation involves selectively performing, in response to said comparison of the coordinate value of said (N−1)-th order midpoint along said first coordinate axis with said input gray-level value, one of an operation determining said first control point to the N-th control point after said update operation as said minimum control point, said first order minimum midpoint to the (N−2)-th order minimum midpoint and said (N−1)-th order midpoint, respectively, and an operation determining said first control point to N-th control point after said update operation as said (N−1)-th order midpoint, (N−2)-th order maximum midpoints to first order maximum midpoints and said maximum control point, respectively, and wherein said processing circuit obtains said output gray-level value from at least a coordinate value of coordinate values along said second coordinate axis of said first control point to the N-th control point obtained by the repetition of said update operation.

3. The display data correction apparatus according to claim 2, wherein said N is three, wherein said processing circuit includes a plurality of serially-connected unit operation stages each configured to perform said update operation, wherein each of said unit operation stages includes:

a first input node receiving a first coordinate value along said first coordinate axis of said first control point before said update operation;

a second input node receiving a second coordinate value along said first coordinate axis of a second control point before said update operation;

a third input node receiving a third coordinate value along said first coordinate axis of a third control point before said update operation;

a fourth input node receiving a fourth coordinate value along said second coordinate axis of said first control point before said update operation;

a fifth input node receiving a fifth coordinate value along said second coordinate axis of said second control point before said update operation;

a sixth input node receiving a sixth coordinate value along said second coordinate axis of said third control point before said update operation;

a first adder including a first input of the first adder connected to said first input node and a second input of the first adder connected to said second input node;

a second adder including a first input of the second adder connected to said second input node and a second input of the second adder connected to said third input node;

a third adder including a first input of the third adder connected to an output of said first adder and a second input of the third adder connected to an output of said second adder;

a fourth adder including a first input of the fourth adder connected to said fourth input node and a second input of the fourth adder connected to said fifth input node;

a fifth adder including a first input of the fifth adder connected to said fifth input node and a second input of the fifth adder connected to said sixth input node;

a sixth adder including a first input of the sixth adder connected to an output of said fourth adder and a second input of the sixth adder connected to an output of said fifth adder;

a comparator including a first input of the comparator fed with said input gray-level value and a second input of the comparator connected to an output of said third adder;

a first selector including a first input of the first selector connected to said first input node, a second input of the first selector connected to the output of said third adder and an output of the first selector connected to a first output node from which a seventh coordinate value along said first coordinate axis of said first control point after said update operation is outputted, and selecting the first input and the second input of the first selector in response to an output value of said comparator;

a second selector including a first input of the second selector connected to the output of said first adder, a second input of the second selector connected to the output of said second adder and an output of the second selector connected to a second output node from which a eighth coordinate value along said first coordinate axis of said second control point after said update operation is outputted, and selecting the first input and the second input thereof in response to the output value of said comparator;

a third selector including a first input of the third selector connected to the output of said third adder, a second input of the third selector connected to said third input node and an output of the third selector connected to a third output node from which a ninth coordinate value along said first coordinate axis of said third control point after said update operation is outputted, and selecting the first input and the second input thereof in response to the output value of said comparator;

a fourth selector including a first input of the fourth selector connected to said fourth input node, a second input of the fourth selector connected to an output of said sixth adder and an output of the fourth selector connected to a fourth output node from which a tenth coordinate value along said second coordinate axis of said first control point after said update operation is outputted, and selecting the first input and the second input thereof in response to the output value of said comparator;

a fifth selector including a first input of the fifth selector connected to the output of said fourth adder, a second input connected to the output of said fifth adder and an output of the fifth selector connected to a fifth output node from which an eleventh coordinate value along said second coordinate axis of said second control point after said update operation is outputted, and selecting the first input and the second input thereof in response to the output value of said comparator; and a sixth selector including a first input of the sixth selector connected to the output of said sixth adder, a second input connected to said sixth input node and an output of the sixth selector connected to a sixth output node from which a twelfth coordinate value along said second coordinate axis of said third control point after said update operation is outputted, and selecting the first input and the second input thereof in response to the output value of said comparator.

4. The display data correction apparatus according to claim 1, wherein N is three, wherein, in a case where a first shifted control point is defined as a point obtained by parallel displacement of said first control point before said update operation by cooperative values along said first and second axes of said second control point before said update operation, a third shifted control point is defined as a point obtained by parallel displacement of said third control point before said update operation by cooperative values along said first and second axes of said second control point before said update operation, a first shifted midpoint is defined as a midpoint of said first shifted control point and an origin of said coordinate system, a second shifted midpoint is defined as a midpoint of said third shifted control point and said origin, and a third shifted midpoint is defined as a midpoint of said first and second shifted midpoints, when said update operation is implemented for the first time, a target gray-level value is obtained by subtracting the coordinate value along said first coordinate axis of said second control value before said update operation from said input gray-level value, and operation (a) or (b) is performed in response to a result of a comparison of a coordinate value along said first coordinate axis of said third shifted midpoint, said operation (a) involving determining coordinate values of said first, second and third control points after said update operation as coordinate values of said first shifted control point, said first shifted midpoint and said third shifted midpoint, respectively, and said operation (b) involving determining the coordinate values of said first, second and third control points after said update operation as coordinate values of said third shifted control point, said second shifted midpoint and said third shifted midpoint, wherein, when said update operation is implemented for the second time or later, said target gray-level value is updated by subtracting a coordinate value along said first coordinate axis of said second control point before said update operation from said target gray-level value before said update operation, and said operation (a) or (b) is performed in response to a result of comparison of a coordinate value along said first coordinate axis of said third shifted midpoint with said updated target gray-level value, and wherein said processing circuit obtains said output gray-level value as a value obtained by accumulating a coordinate value along said second coordinate axis of said second control point initially selected and coordinate values along said second coordinate axis of said second control points which are subjected to the parallel displacements.

5. The display data correction apparatus according to claim 4, wherein the coordinate values of only one of said first and second control points after said update operation are stored in said processing circuit.

6. The display data correction apparatus according to claim 4, wherein said processing circuit includes an initial operation stage configured to perform said first update operation, wherein said initial operation stage comprises:

a first input node fed with a coordinate value of the first input node along said first coordinate axis of said first control point initially selected;

a second input node fed with a coordinate value of the second input node along said first coordinate axis of said second control point initially selected;

a third input node fed with a coordinate value of the third input node along said first coordinate axis of said third control point initially selected;

a fourth input node fed with a coordinate value of the fourth input node along said second coordinate axis of said first control point initially selected;

a fifth input node fed with a coordinate value of the fifth input node along said second coordinate axis of said second control point initially selected;

a sixth input node fed with a coordinate value of the sixth input node along said second coordinate axis of said third control point initially selected;

a first subtracter including a first input of the first subtracter fed with said input gray-level value and a second input of the first subtracter connected to said second input node;

a second subtracter including a first input of the second subtracter connected to said first input node and a second input of the second subtracter connected to said second input node;

a third subtracter including a first input of the third subtracter connected to said third input node and a second input of the third subtracter connected to said second input node;

a first adder including a first input of the first adder connected to an output of said second subtracter and a second input of the first adder connected to an output of said third subtracter;

a fourth subtracter including a first input of the fourth subtracter connected to said fourth input node and a second input of the fourth subtracter connected to said fifth input node;

a fifth subtracter including a first input of the fifth subtracter connected to said sixth input node and a second input of the fifth subtracter connected to said fifth input node;

a second adder including a first input of the second adder connected to an output of said fourth subtracter and a second input of the second adder connected to an output of said fifth subtracter;

a first comparator including a first input of the first comparator connected to an output of said first subtracter and a second input of the first comparator connected to an output of said first adder;

a first selector including a first input of the first selector connected to the output of said second subtracter and a second input of the first selector connected to the output of said third subtracter and selecting first and second inputs thereof in response to an output value of said first comparator;

a second selector including a first input of the second selector connected to the output of said fourth subtracter and a second input of the second selector connected to the output of said fifth subtracter and selecting first and second inputs of the second selector in response to the output value of said first comparator;

a first output node connected to the output of said first subtracter to output said target gray-level value;

a second output node connected to an output of said first selector to output a coordinate value along said first coordinate axis of said second control point after said update operation;

a third output node connected to the output of said first adder to output a coordinate value along said first coordinate axis of said third control point after said update operation;

a fourth output node connected to an output of said second selector to output a coordinate value along said second coordinate axis of said second control point after said update operation; and a fifth output node connected to the output of said second adder to output a coordinate value along said second coordinate axis of said third control point after said update operation.

7. The display data correction apparatus, according to claim 6, wherein said processing circuit further includes a plurality of unit operation stages serially-connected to outputs of said initial operation stage, each of said unit operation stages being configured performing said update operation, wherein each of said unit operation stages comprises:

a seventh input node fed with said target gray-level value before said update operation;

an eighth input node fed with a coordinate value along said first coordinate axis of said second control point before said update operation;

a ninth input node fed with a coordinate value along said first coordinate axis of said third control point before said update operation;

a tenth input node fed with a coordinate value along said second coordinate axis of said second control point before said update operation;

an eleventh input node fed with a coordinate value along said second coordinate axis of said third control point before said update operation;

a sixth subtracter including a first input of the sixth subtractor connected to said seventh input node and a second input of the sixth subtractor connected to said eighth input node;

a seventh subtracter including a first input of the seventh subtractor connected to said eighth input node and a second input of the seventh subtractor connected to said ninth input node;

an eighth subtracter including a first input of the eighth subtractor connected to said tenth input node and a second input of the eighth subtractor connected to said eleventh input node;

a second comparator including a first input of the second comparator connected to an output of said sixth subtracter and a second input of the second comparator connected to said ninth input node;

a third selector including a first input of the third selector connected to said eighth input node and a second input of the third selector connected to an output of said seventh subtracter and selecting the first and second inputs thereof in response to an output value of said second comparator;

a fourth selector including a first input of the fourth selector connected to said tenth input node and a second input of the fourth selector connected to an output of said eighth subtracter and selecting the first and second inputs thereof in response to the output value of said second comparator;

a third adder;

a sixth output node connected to the output of said sixth subtracter to output said target gray-level level after said update operation;

a seventh output node connected to an output of said third selector to output a coordinate value along said first coordinate value of said second control point after said update operation;

an eighth output node outputting a value obtained by rounding down lower two bits of a coordinate value along said first coordinate axis of said third control point before said update operation as a coordinate value along said first coordinate axis of said third control point after said update operation;

a ninth output node connected to an output of said fourth selector to output a coordinate value along said second coordinate axis of said second control point after said update operation;

a tenth output node outputting a value obtained by rounding down lower two bits of a coordinate value along said second coordinate axis of said third control point before said update operation as a coordinate value along said second coordinate axis of said third control point after said update operation; and an eleventh output node connected to an output of said third adder, wherein said third adder of one of said unit operation stages which is directly connected to the outputs of said initial operation stage has a first input connected to said tenth input node thereof and a second input fed with the coordinate value along said second coordinate axis of said second control point initially selected, and wherein each of said third adders of others of said unit operation stages which is directly connected to the outputs of said initial operation stage has a first input connected to said tenth input node thereof and a second input connected to said eleventh output node of a previous unit operation stage thereof.

8. The display data correction apparatus according to claim 1, wherein said processing circuit includes a plurality of serially-connected unit operation stages each configured to perform said update operation, and wherein input nodes of each of said plurality of unit operation stages are each connected to a flip-flop.

9. The display data correction apparatus according to claim 1, wherein said processing circuit includes a plurality of serially-connected unit operation stages each configured to perform said update operation, and wherein input nodes of every M unit operation unit out of said plurality of unit operation stages are each connected to a flip-flop, M being an integer of two or more.

10. The display data correction apparatus according to claim 1, wherein said select circuit stores coordinate values of a plurality of potential control points which are potentially selected as said first to third control points, wherein said select circuit calculates coordinate values of at least one of said first to third control points through performing an arithmetic operation on the coordinate values of said plurality of potential control points.

11. The display data correction apparatus according to claim 1, further comprising a gray-level value inverter, wherein said output gray-level value obtained by said processing circuit corresponds to one of gray-level voltages of positive and negative polarities with respect to a common level, and wherein said gray-level value inverter obtains a gray-level value corresponding to the other of said gray-level voltages of the positive and negative polarities through performing an arithmetic operation on said output gray-level value.

12. A display panel driver for driving data lines of a display panel, comprising:

a control circuit responsive to an input gray-level value for initially selecting a first control point to an N-th control point ($N \geq 3$) defined in a coordinate system in which a first coordinate axis is associated with said input gray-level value and a second coordinate axis is associated with an output gray-level value to be calculated for said input gray-level value;

a V-T (voltage-to-transmission) arithmetic processing circuit obtaining the output gray-level value by repeating an update operation in which said first control point to the N-th control point are updated;

a drive circuitry driving a data line from among the data lines for a display panel in response to said output gray-level value received from said V-T arithmetic processing circuit, wherein, in said update operation, a first operation and a second operation are selectively performed in response to a result of a comparison of a coordinate value of an (N−1)-th order midpoint along said first coordinate axis with said input gray-level value, wherein said first operation involves determining coordinate values of said first control point to the N-th control point after said update operation in response to coordinate values of a minimum control point, a first order minimum midpoint to an (N−2)-th order minimum midpoint and said (N−1)-th order midpoint before said update operation, wherein said second operation involves determining the coordinate values of said first control point to the N-th control point after said update operation in response to coordinate values of a maximum control point before said update operation, a first order maximum midpoint to an (N−2)-th order maximum midpoint and said (N−1)-th order midpoint before the update operation, wherein the update operation is repeatedly performed in an operation range having gray-level values according to the input gray-level value while narrowing the operation range, and the output gray-level value is calculated for said input gray-level value, wherein said first order maximum and minimum midpoints are each defined as a midpoint between two adjacent control points of said first control point to said N-th control point, a number of said first order maximum and minimum midpoints being N−1, the two adjacent control points of said first control point to the N-th control point comprising a control point of said first control point to the N-th control control point and another control point of said first control point to the N-th control point being closest in distance with the control point of said first control point to N-th control point, wherein (k+1)-th order midpoints are each defined as a midpoint between two adjacent k-th order midpoints of from among k-th order midpoints fork satisfying $1 \leq k \leq N-2$, a number of said (k+1)-th order midpoints being N−k−1, the two adjacent k-th order midpoints of said k-th order midpoints comprising a k-th order midpoint of said k-th order midpoints and another k-th order midpoint of said k-th order midpoints being closest in distance with the k-th order midpoint of said k-th order midpoints, wherein said minimum control point is defined as a control point which has a smallest coordinate value along said first coordinate axis among said first control point to the N-th control point, wherein said maximum control point is defined as a control point which has a largest coordinate value along said first coordinate axis among said first control point to the N-th control point, wherein a k-th order minimum midpoint is defined as having a smallest coordinate value along said first coordinate axis among said k-th order midpoints, and wherein a k-th order maximum midpoint is defined as having a largest coordinate value along said first coordinate axis among said k-th order midpoints.

13. The display panel driver according to claim 12, wherein said update operation involves selectively performing, in response to a comparison of the coordinate value of said (N−1)-th order midpoint along said first coordinate axis with said input gray-level value, one of an operation determining said first control point to the N-th control point after said update operation as said minimum control point, said first order minimum midpoint to the (N−2)-th order minimum midpoint and said (N−1)-th order midpoint, respectively, and an operation determining said first control point to the N-th control point after said update operation as said (N−1)-th order midpoint, said (N−2)-th maximum midpoint to first maximum midpoint and said maximum control point, respectively, and wherein said V-T arithmetic processing circuit obtains said output gray-level value from at least one of said coordinate values of said first control point to said N-th control point along said second coordinate axis of said first control point to the N-th control point obtained by the repetition of said update operation.

14. The display panel driver according to claim 12, wherein N is three, wherein, in a case where a first shifted control point is defined as a point obtained by parallel displacement of said first control point before said update operation by cooperative values along said first and second axes of said second control point before said update operation, a third shifted control point is defined as a point obtained by parallel displacement of said third control point before said update operation by cooperative values along said first and second axes of said second control point before said update operation, a first shifted midpoint is defined as a midpoint of said first shifted control point and an origin of said coordinate system; a second shifted midpoint is defined as a midpoint of said third shifted control point and said origin, and a third shifted midpoint is defined as a midpoint of said first and second shifted midpoints, when said update operation is implemented for the first time, a target gray-level value is obtained by subtracting the coordinate value along said first coordinate axis of said second control value before said update operation from said input gray-level value, and operation (a) or (b) is performed in response to a result of comparison of a coordinate value along said first coordinate axis of said third shifted midpoint, said operation (a) involving determining coordinate values of said first, second and third control points after said update operation as coordinate values of said first shifted control point, said first shifted midpoint and said third shifted midpoint, respectively, and said operation (b) involving determining the coordinate values of said first, second and third control points after said update operation as coordinate values of said third shifted control point, said second shifted midpoint and said third shifted midpoint, wherein, when said update operation is implemented for the second time or later, said target gray-level value is updated by subtracting a coordinate value along said first coordinate axis of said second control point before said update operation from said target gray-level value before said update operation, and said operation (a) or (b) is performed in response to a result of comparison of a coordinate value along said first coordinate axis of said third shifted midpoint with said updated target gray-level value, and wherein said processing circuit obtains said output gray-level value as a value obtained by accumulating a coordinate value along said second coordinate axis of said second control point initially selected and coordinate values along said second coordinate axis of said second control points which are subjected to the parallel displacements.

15. The display panel driver according to claim 14, wherein the coordinate values of only one of said first and second control points after said update operation are stored in said processing circuit.

16. A display device, comprising:

a display panel including a data line;

a control circuit responsive to an input gray-level value for initially selecting a first control point to an N-th control point (N≥3) defined in a coordinate system in which a first coordinate axis is associated with said input gray-level value and a second coordinate axis is associated with an output gray-level value to be calculated for said input gray-level value;

a processing circuit obtaining the output gray-level value by repeating an update operation in which said first control point to the N-th control point are updated; and a drive circuitry driving said data line in response to the output gray-level value for the display panel, wherein, in said update operation, a first operation and a second operation are selectively performed in response to a result of a comparison of a coordinate value of an (N−1)-th order midpoint along said first coordinate axis with said input gray-level value, wherein said first operation involves determining coordinate values of said first control point to the N-th control point after said update operation in response to coordinate values of a minimum control point, a first order minimum midpoint to an (N−2)-th order minimum midpoint and said (N−1)-th order midpoint before said update operation, wherein said second operation involves determining the coordinate values of said first control point to the N-th control point after said update operation in response to coordinate values of a maximum control point before said update operation, a first order maximum midpoint to an (N−2)-th order maximum midpoint and said (N−1)-th order midpoint before the update operation, wherein the update operation is repeatedly performed in an operation range having gray-level values according to the input gray-level value while narrowing the operation range, and the output gray-level value is calculated for said input gray-level value, wherein said first order maximum and minimum midpoints are each defined as a midpoint between two adjacent control points of said first control point to the N-th control control point, a number of said first order maximum and minimum midpoints being N−1, the adjacent control points of said first control point to the N-th control point comprising a control point of said first control point to the N-th control point and another control point of said first control point to the N-th control control point being closest in distance with the control point of said first control point to the N-th control point, wherein (k+1)-th order midpoints are each defined as a midpoint between two adjacent k-th order midpoints of k-th order midpoints fork satisfying $1 \leq k \leq N-2$, a number of said (k+1)-th order midpoints being N−k−1, the two adjacent k-th order midpoints of said k-th order midpoints comprising a k-th order midpoint of said k-th order midpoints and another k-th order midpoint of said k-th order midpoints being closest in distance with the one of said k-th order midpoints, wherein said minimum control point is defined as a control point which has a smallest coordinate value along said first coordinate axis among said first control point to the N-th control point, wherein said maximum control point is defined as a control point which has a largest coordinate value along said first coordinate axis among said first control point to the N-th control point;

wherein a k-th order minimum midpoint is defined as having a smallest coordinate value along said first coordinate axis among said k-th order midpoints, and wherein a k-th order maximum midpoint is defined having a largest coordinate value along said first coordinate axis among said k-th order midpoints.

17. The display data correction apparatus, according to claim 1, wherein the update operation is repeatedly performed only in the operation range having gray-level values adjacent to the input gray-level value while narrowing the operation range, and the output gray-level value is calculated for the input gray-level value, wherein the processing circuit performs the update operation to gamma correct the display data.

* * * * *